US007203438B2

(12) United States Patent
Omata et al.

(10) Patent No.: US 7,203,438 B2
(45) Date of Patent: Apr. 10, 2007

(54) IMAGE HEATING APPARATUS AND HEATER FOR USE THEREIN

(75) Inventors: Masahito Omata, Mishima (JP); Hisashi Nakahara, Numazu (JP); Yusuke Nakazono, Mishima (JP); Satoshi Nishida, Numazu (JP); Eiji Uekawa, Mishima (JP); Isamu Takeda, Numazu (JP); Noriyuki Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 213 days.

(21) Appl. No.: 11/038,066

(22) Filed: Jan. 21, 2005

(65) Prior Publication Data

US 2005/0163523 A1 Jul. 28, 2005

(30) Foreign Application Priority Data

Jan. 23, 2004 (JP) ..... 2004-015173
Jan. 7, 2005 (JP) ..... 2005-002697

(51) Int. Cl.
*G03G 15/20* (2006.01)

(52) U.S. Cl. ..... 399/69; 399/334

(58) Field of Classification Search ..... 399/69, 399/334, 330; 338/314
See application file for complete search history.

(56) References Cited

U.S. PATENT DOCUMENTS 4,211,994 A * 7/1980 Oda ..... 338/21
4,813,372 A * 3/1989 Kogure et al. ..... 118/60
5,822,670 A * 10/1998 Morigami ..... 399/334
6,094,559 A 7/2000 Otsuka et al. ..... 399/327
6,175,699 B1 1/2001 Kato et al. ..... 399/69
6,185,383 B1 * 2/2001 Kanari et al. ..... 399/45
6,459,878 B1 10/2002 Tomoyuki et al. ..... 399/331
6,516,166 B2 2/2003 Sakakibara et al. ..... 399/69
6,671,488 B2 12/2003 Izawa et al. ..... 399/329
6,734,397 B2 5/2004 Kato et al. ..... 219/216
6,748,192 B2 6/2004 Izawa et al. ..... 399/329
6,763,205 B2 7/2004 Izawa et al. ..... 399/69
6,787,737 B2 9/2004 Uekawa et al. ..... 219/216
6,794,611 B2 9/2004 Kataoka et al. ..... 219/216

(Continued)

FOREIGN PATENT DOCUMENTS

EP 0 486 890 A1 5/1992

(Continued)

*Primary Examiner*—Anjan Deb
(74) *Attorney, Agent, or Firm*—Fitzpatrick, Cella, Harper & Scinto

(57) ABSTRACT

Image heating apparatus capable of preventing an excessive temperature increase in a sheet non-passing area and heater for use in the image heating apparatus including: a substrate, a heat generating resistor formed on the substrate, and first and second electrodes for supplying an electric power to the heat generating resistor. Each of the first and second electrodes has a first area to contact a power supplying connector and a second area provided at an end portion electrically opposite to the first area along a longitudinal direction of the substrate, and the heat generating resistor is provided to electrically connect the second area of the first and second electrode so that when the heater is at a set temperature for an image heating operation a resistance value Rc of the second area, and a resistance value Rt between a portion within the second area of the first and second electrode and electrically closest to the first area satisfy a relation Rc/Rt<=1/30.

14 Claims, 11 Drawing Sheets

U.S. PATENT DOCUMENTS

| | | | | |
|---|---|---|---|---|
| 6,865,362 | B2 | 3/2005 | Otsuka et al. | 399/329 |
| 2004/0047641 | A1 | 3/2004 | Kato et al. | 399/45 |
| 2004/0120737 | A1 | 6/2004 | Kataoka et al. | 399/328 |
| 2004/0120740 | A1 | 6/2004 | Uekawa et al. | 399/329 |
| 2004/0132597 | A1 | 7/2004 | Sakakibara et al. | 492/56 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-204980 | 7/1992 |
| JP | 5-19652 | 1/1993 |
| JP | 7-160131 | 6/1995 |
| JP | 2000-58232 | 2/2000 |
| JP | 2000-223244 | 8/2000 |

* cited by examiner

IMAGE HEATING APPARATUS AND HEATER FOR USE THEREIN

CROSS REFERENCE TO RELATED APPLICATION

This application claims priority from Japanese Patent Application Nos. 2004-015173 filed Jan. 23, 2004 and 2005-002697 filed Jan. 7, 2005, which are hereby incorporated by reference herein.

BACKGROUND OF THE INVENTION

1. Field of the Invention

The present invention relates to an image heating apparatus adapted for use as a heat fixing apparatus to be mounted in a copying apparatus or a printer utilizing an electrophotographic recording technology or an electrostatic recording technology and a heater to be used in such apparatus, and more particularly to an image heating apparatus for heating an image by passing a recording material, bearing an image, through a nip portion between a heater and a backup member and a heater to be used in such apparatus.

2. Related Background Art

In the following, there will be explained an example of a prior image heating apparatus equipped in an image forming apparatus such as a copying apparatus or a printer, as an image heating apparatus (fixing apparatus) for heat fixing a toner image to a recording material.

In such image forming apparatus, an image heating apparatus of a heat roller type is widely employed as a fixing apparatus for heat fixing an unfixed image (toner image) of image information, formed and borne on a recording material (transfer sheet, electrofax sheet, electrostatic recording sheet, OHP sheet, printing paper, formatted paper etc.) by a transfer process or a direct process in an image forming process means utilizing a suitable image forming process such as an electrophotographic process, an electrostatic recording process or a magnetic recording process, as a permanently fixed image onto the surface of such recording material.

Recently an image heating apparatus of a film heating type is commercialized as a configuration capable of reducing a wait time from the entry of a print instruction to the start of a printing operation (quick start) and reducing the electric power consumption (energy saving). The image heating apparatus of such film heating type is proposed for example in Japanese Patent Application Laid-open Nos. S63-313182, H2-157878, H4-44075 and H4-204980.

The image heating apparatus of such film heating type is provided, as shown in FIG. 6, with a heater 13, a holder 11 for supporting the heater 13, a film (rotary member) 12 rotating in contact with the heater 13, and a pressure roller 18 which forms a nip portion with the heater 13 across the film 12. The pressure roller 18 is provided, on a metal core 19, with an elastic layer 19 formed for example of silicone rubber. The heater 13 is formed by printing, on a heat resistant substrate 14 for example of a ceramic material, a heat generating member 15 (also called resistor pattern), and a glass coating layer 16 for covering the heat generating member 15. For detecting the temperature of the substrate 14, a temperature detecting element 17 is provided. At the heating fixing of the toner image on the recording sheet, a current supply to the heat generating member 15 is controlled by unillustrated control means in such a manner that a temperature detected by the temperature detecting element 17 is maintained at a predetermined fixing temperature.

Also the arrangement of the heat generating member 15 is shown in a plan view in FIG. 7. In an example illustrated in (a) of FIG. 7, the heat generating member 15 is provided in one turn on the heat substrate 14. 210*a* indicates electrodes for connection with a connector in a main body of the printer, and 210*b* is a low-resistance conductor for connecting two heat generating members. The heat generating member 15 is proposed in various forms, and may be composed, as shown in (b) of FIG. 7, of a heat generating member 15 in a forward part and a low-resistance conductor (part of electrode) 210*b* in a return part. The recording sheet bearing the toner image is conveyed under pinching in the nip portion thereby being heat fixed.

The image heating apparatus applied as a fixing apparatus as explained above is also usable as an apparatus for improving a surface property such as glossiness by heating an image-bearing recording material, or a temporary fixing apparatus.

The image heating apparatus of such film heating type can be constructed as an apparatus of on-demand type utilizing members of a low heat capacity as a ceramic heater and a fixing film, and can be brought to a state heated to a predetermined fixing temperature by energizing the ceramic heater constituting a heat source only during execution of an image formation in the image forming apparatus, thereby providing advantages of significantly reducing a waiting time from the start of power supply in the image forming apparatus to a state capable of image formation (quick start property) and of significantly reducing the electric power consumption in a stand-by state (power saving).

However, in case of a continuous printing operation on small-sized sheets, there results a phenomenon of gradual temperature increase in an area not passed by the paper in the longitudinal direction of the fixing nip portion (temperature increase in sheet non-passing area). An excessively high temperature in the sheet non-passing area causes damages in various parts in the apparatus, and a printing operation on a large-sized sheet in a state with the temperature increase in the sheet non-passing area results in a high-temperature offset phenomenon in an area corresponding to the sheet non-passing area for the small-sized sheet.

As a countermeasure for such excessive temperature increase in the sheet non-passing area, it is conceived to provide the heater substrate with plural heat generating members corresponding to the sizes of the recording sheets used on the printer, but such method of forming plural heat generating members corresponding to the number of sizes is impractical as the recording sheets used on the printer have very many sizes.

Also there can be conceived a method, in a continuous printing operation on small-sized sheets, of increasing a gap between a preceding sheet and a succeeding sheet thereby relaxing the excessive temperature increase in the sheet non-passing area, but such method is associated with a drawback of significantly decreasing the number of the output sheets per unit time.

In order to suppress the excessive temperature increase in the sheet non-passing area without a significant decrease in the number of the output sheets per unit time, there is proposed, as disclosed for example in Japanese Patent Application Laid-open Nos. H5-19652 and H7-160131, a configuration of providing two electrodes along the longitudinal direction of the heater substrate and forming a heat generating member having a positive temperature coefficient (PTC) between such electrodes. An example of such configuration is shown in FIG. 8, in which there are shown a heater substrate 14 and electrodes 21, 22, and power supply connectors are connected to areas 21*a*, 22*a*. The two electrodes 21, 22 are provided along the longitudinal direction of the substrate 14, and a heat generating resistor 15 is connected between the two electrodes. FIG. 9 is an electrical equivalent circuit diagram of the heater shown in FIG. 8. As will be apparent from FIG. 9, this heater can be regarded as a configuration having numberless resistors 15*r* connected in parallel between the two electrodes 21 and 22 (hereinafter a heater of this type will be called a sheet-passing-direction current-feed type).

When a small-sized sheet is passed, an area E passed by the recording sheet shows a scarce temperature increase because the heat is taken away by the recording sheet. Therefore the heat generating member 15 in the sheet passing area does not show an increase of the resistance value thereby maintaining the current supply in the sheet passing area. On the other hand, in a sheet non-passing area, the heat generating member 15 shows an increase in the resistance value because of a temperature increase, thereby suppressing the current and suppressing the excessive temperature increase in the sheet non-passing area.

It is found, however, that such heater, when actually mounted in the fixing device, causes an unevenness in the distribution of heat generation in the longitudinal direction of the heater even when sheets are not passed. Such phenomenon is identified to result from resistances of the electrodes 21, 22. The two electrodes, provided along the longitudinal direction of the heater substrate 14, have a high conductivity but the resistance values thereof are not zero. Therefore the electrodes 21, 22 cause a voltage drop by the resistances thereof, whereby, even in the absence of the passing sheet, a side closer to the areas 21*a*, 22*a* in contact with the current supply connectors (left-hand side portion within the heat generating member 15 in FIG. 8) shows a larger heat generation and a side farther from the areas 21*a*, 22*a* (right-hand side portion within the heat generating member 15 in FIG. 8) shows a smaller heat generation.

SUMMARY OF THE INVENTION

The present invention has been made in consideration of the foregoing situation, and an object thereof is to provide an image heating apparatus capable of suppressing an excessive temperature increase in a sheet non-passing area and a heater adapted for use in such apparatus.

Another object of the present invention is to provide an image heating apparatus capable of suppressing a decrease in the number of output sheets per unit time and a heater adapted for use in such apparatus.

Still another object of the present invention is to provide an image heating apparatus capable of suppressing an unevenness in the temperature distribution in the longitudinal direction of the heater while exploiting the advantages of the heater of sheet-passing-direction current-feed type, and a heater adapted for use in such heater.

Still another object of the present invention is to provide a heater including:

a substrate;

a heat generating resistor formed on said substrate; and first and second electrodes for supplying an electric power to said heat generating resistor;

wherein each of said first and second electrodes has a first area to be contacted with a power supplying connector and a second area provided at an end portion electrically opposite to the first area, the second areas are provided along a longitudinal direction of said substrate and said heat generating resistor is so provided as to electrically connect the second area of said first electrode and the second area of said second electrode;

wherein, within the second area of said first electrode, a portion electrically closest to the first area of said first electrode is provided in the vicinity of an end portion of said substrate in the longitudinal direction thereof, and within the second area of said second electrode, a portion electrically closest to the first area of said second electrode is provided in the vicinity of the other end portion of said substrate in the longitudinal direction thereof; and wherein, when the heater is at a set temperature for an image heating operation in said image heating apparatus, a resistance value Rc of the second area of either of said first and second electrodes and a resistance value Rt between a portion within the second area of said first electrode electrically closest to the first area of said first electrode and a portion within the second area of said second electrode electrically closest to the first area of said second electrode satisfy a relation:

$$Rc/Rt \leqq 1/30,$$

and an image heating apparatus equipped with such heater.

Still another object of the present invention is to provide a heater including:

a substrate;

a heat generating resistor formed on said substrate; and first and second electrodes for supplying an electric power to said heat generating resistor;

wherein each of said first and second electrodes has a first area to be contacted with a power supplying connector and a second area provided at an end portion electrically opposite to the first area, the second areas are provided along a longitudinal direction of said substrate and said heat generating resistor is so provided as to electrically connect the second area of said first electrode and the second area of said second electrode;

wherein, within the second areas of said first and second electrodes, portions electrically closest to the first areas are provided in the vicinity of an end portion of said substrate in the longitudinal direction thereof; and wherein, when the heater is at a set temperature for an image heating operation in said image forming apparatus, a resistance value Rc of the second area of either of said first and second electrodes and a resistance value Rt between a portion within the second area of said first electrode electrically closest to the first area of said first electrode and a portion within the second area of said second electrode electrically closest to the first area of said second electrode satisfy a relation:

$$Rc/Rt \leqq 1/60,$$

and an image heating apparatus equipped with such heater.

Still other objects of the present invention will become fully apparent from the following detailed description which is to be taken in conjunction with the accompanying drawings.

DETAILED DESCRIPTION OF THE PREFERRED EMBODIMENTS (Embodiment 1)

(1) Example of Image Forming Apparatus

Figure 1:
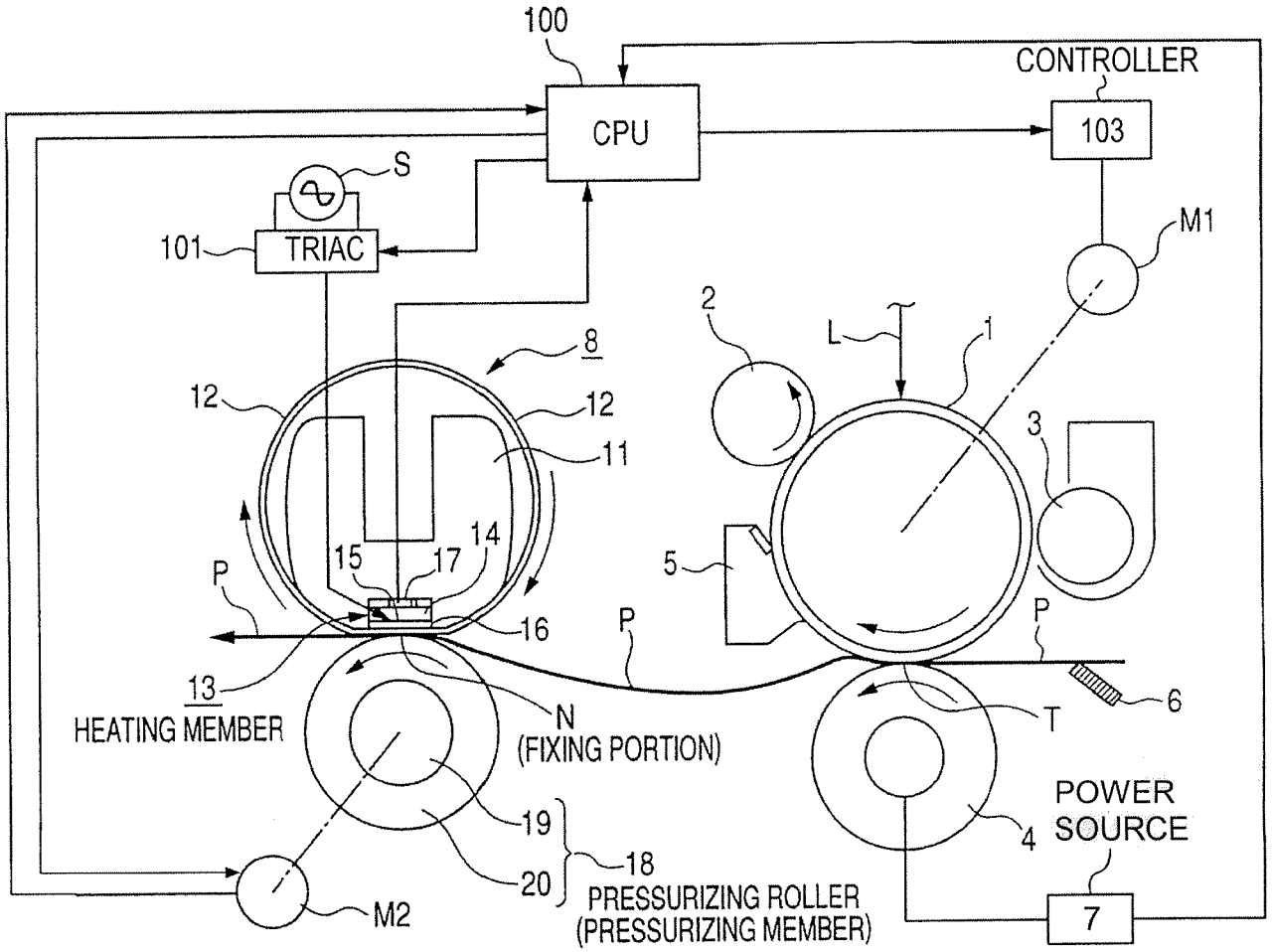
FIG. 1 is a schematic view of an image forming apparatus equipped with an image heating apparatus of the present invention.

FIG. 1 is a schematic view showing a configuration of an image forming apparatus. The image forming apparatus of the present embodiment is a copying apparatus or a printer utilizing an electrophotographic process of transfer type. In the image forming apparatus of the present embodiment, a largest usable recording material is of a letter size (216×279 mm), and the recording material of such letter size can be conveyed with the longer side (279 mm) thereof parallel to the conveying direction. Also conveying of the recording material is executed taking, as a reference, a longitudinal center of a heat generating resistor of a fixing apparatus to be explained later.

An electrophotographic photosensitive member 1 of a drum shape (hereinafter represented as photosensitive drum) serves as a latent image bearing member and is rotated with a predetermined process speed, in a clockwise direction as indicated by an arrow. A main motor M1 of a main body of the image forming apparatus drives the photosensitive drum 1 etc. A controller 103 for the motor M1 is controlled by a CPU 100. The photosensitive drum 1 has an external diameter of about 24 mm and is subjected, in the rotation thereof, to a uniform primary charging process of predetermined polarity and potential by primary charging means 2 (charging roller in the present embodiment). Thus charged surface is subjected to an optical image exposure L by an unillustrated exposure apparatus (such as a slit focusing exposure means of an original image or a laser beam scan exposure means), whereby an electrostatic latent image of desired image information is formed. Then the latent image is rendered visible as a toner image by development means 3. The toner image is transferred in succession, at a transfer portion T (hereinafter called transfer nip) formed by a pressure contact nip of the photosensitive drum 1 and a transfer roller 4 constituting transfer means, onto a recording material P fed at a predetermined timing from an unillustrated sheet feeding portion. A bias, applied from a power source 7 to the transfer roller 4, is controlled at a constant voltage by an unillustrated control circuit. The recording material P, having receiving the transfer of the toner image at the transfer portion T, is separated from the surface of the photosensitive drum 1, then conveyed to an image heat fixing apparatus 8 constituting an image heating apparatus to be explained later, and subjected to a heat fixing process for the toner image, thereby being outputted as a formed image (copy or print). Timings of biases applied to the development means and the transfer roller are controlled by on/off signals of a sensor 6 (hereinafter called top sensor). The present embodiment employs a photointerruptor as the top sensor. After the toner image transfer onto the recording material P, the surface of the photosensitive drum 1 is subjected to an elimination of residual deposits such as transfer residual toner by cleaning means 5, and is used again for image formation.

(2) Fixing Apparatus 8

The fixing apparatus 8 of the present embodiment is an image heating apparatus of film heating process of pressure member-driven tensionless type. A laterally oblong stay 11 of a heat resistant resinous material serves as an internal guide member for a following endless heat-resistant film (also called a fixing film or a flexible sleeve) 12. An endless heat-resistant film 12 is fitted externally on the aforementioned stay 11 including a heater 13 serving as a heating member. The endless heat-resistant film 12 has an internal peripheral length longer by about 3 mm than an external peripheral length of the stay 11 including the heater 13, whereby the film 12 is loosely fitted, with a margin in the peripheral length, on the stay 11 including the heater 13. The film 12 has a total thickness of about 40–100 μm in order to reduce the heat capacity thereby improving the quick starting ability, and is formed by a material with a heat resistance, a releasing property, a strength and a durability as a single-layered film of PI, PTFE, PFA or FEP or a composite-layered film formed by polyimide, polyamidimide, PEEK, PES or PPS externally coated with PTFE, PFA or FEP. The present embodiment employs a polyimide film externally provided with a coated layer constituted of a fluorinated resin such as PTFE or PFA and a conductive material, but such example is not restrictive. There can also be employed a metal tube or the like. The heater 13 constituting the heating member is formed by applying, in an approximately central portion of a surface of a heat substrate 14 of a highly heat conductive material such as alumina or aluminum nitride and along a longitudinal direction thereof, an electrical resistance material (heat generating resistor) 15 for example of Ag/Pd (silver palladium) with a thickness of several tens of microns for example by a screen printing, and coating thereon glass or fluorinated resin as a protective layer 16. A pressure roller 18 constitutes a backup member for forming a fixing portion (nip portion) N with the heater 13 across the film 12 and serving to drive the film 12, and is constituted of a shaft core 19 for example of aluminum, iron or stainless steel and a roller portion 20 formed by a releasing heat-resistant rubber elastomer of a thickness of 3 mm and an external diameter of 20 mm and fitted externally on the core shaft. It is provided on the surface thereof with a coated layer of a dispersed fluorinated resin, in order to secure a conveying property for the recording material P and the fixing film 12 and to avoid stain by the toner. An end of the metal core 19 is rotated by a driving motor M2 of the fixing apparatus whereby the pressure roller 18 is rotated counterclockwise as indicated by an arrow to drive the endless heat-resistant film 12 in a clockwise direction as indicated by an arrow, with the internal surface thereof in sliding contact with the surface of the heater 13. In a non-driven state, the endless heat-resistant film 12 is maintained in a tension-free state in the substantially entire peripheral length thereof except for a portion pinched in the nip portion N between the heater 13 and the pressure roller 18. When the pressure roller 18 is rotated, the film 12 is given a driving force in the nip portion N by a friction with the pressure roller 18, and is rotated clockwise with a speed substantially same as the peripheral speed of the pressure roller 18, with the internal surface of the film in sliding contact with the surface of the heater 13 (namely the surface of the protective layer 16). In such film driven state, the film is given a tension only at the nip portion N and at an upstream side of the nip portion N in the moving direction of the film and within a range between the guide portion which is inside the film and in the vicinity of the nip portion, and the nip portion.

Such loose fitting and driving of the film allow to reduce a laterally displacing force of the film in the longitudinal direction of the heater in the course of the film rotation, thereby dispensing with means for controlling the lateral displacement of the film. Also the driving torque can be lowered, thereby achieving a simplification, a compact configuration and a lower cost of the apparatus.

Now, in a state where the film is driven as described above and an electric power is supplied to the heat generating member layer 15 of the heater 13, when a recording material P bearing an unfixed toner image is introduced, with an image bearing surface upwards, into the fixing nip portion N between the rotating film 12 and the rotating pressure roller 18, the recording material P passes through the nip portion N together with the film 12 and the toner image is heat fixed by a thermal energy of the heater 13, in contact with the internal surface of the film at the nip portion N, supplied to the recording material P through the film 12, and a pressure of the nip portion N.

The heat generating member layer 15 of the heater 13, when given a voltage (electric power), generates heat to heat the substrate 14 whereby the entire heater 13 of a low heat capacity shows a rapid temperature increase. The temperature of the heater 13 is controlled by fetching an output of a thermistor 17, provided on the heater 13, into the CPU 100 after an A/D conversion, and, based on such information, controlling an AC voltage supplied to the heat generating member layer 15 of the heater 13 for example by a phase/frequency control through a triac 101. S indicates an AC power source.

During a process of fixing the toner image on the recording material, control means (CPU 100) so controls the power supply to the heat generating resistor 15 as that a temperature detected by the thermistor 17 is maintained at a set temperature (fixing temperature). The set temperature during the fixing process is set by the CPU 100 for example according to a temperature level of the pressure roller 18 (estimable by counting a print number in a continuous printing operation or by counting a time thereof), and a type of the recording material (plain paper, thick paper, resinous sheet etc.). Therefore, the set temperature is provided in plural values (or variable) for a single printer (fixing apparatus).

For securing a stable fixing property, the thermistor 17 detects a temperature of the rear surface of the heater 13 (opposite to the surface in contact with the fixing film) at about the reference portion for the conveying of the recording material (in the present embodiment, about the center of the longitudinal direction of the heat generating resistor), and the power supply is so controlled as to elevate the temperature of the heater 13 in case the temperature detected by the thermistor 17 is lower than a predetermined set temperature and to lower the temperature of the heater 13 in case the temperature detected by the thermistor 17 is higher than the predetermined set temperature, whereby the sheet passing portion of the heater 13 is controlled at a constant temperature in the fixing operation.

(Heater)

Figure 2:
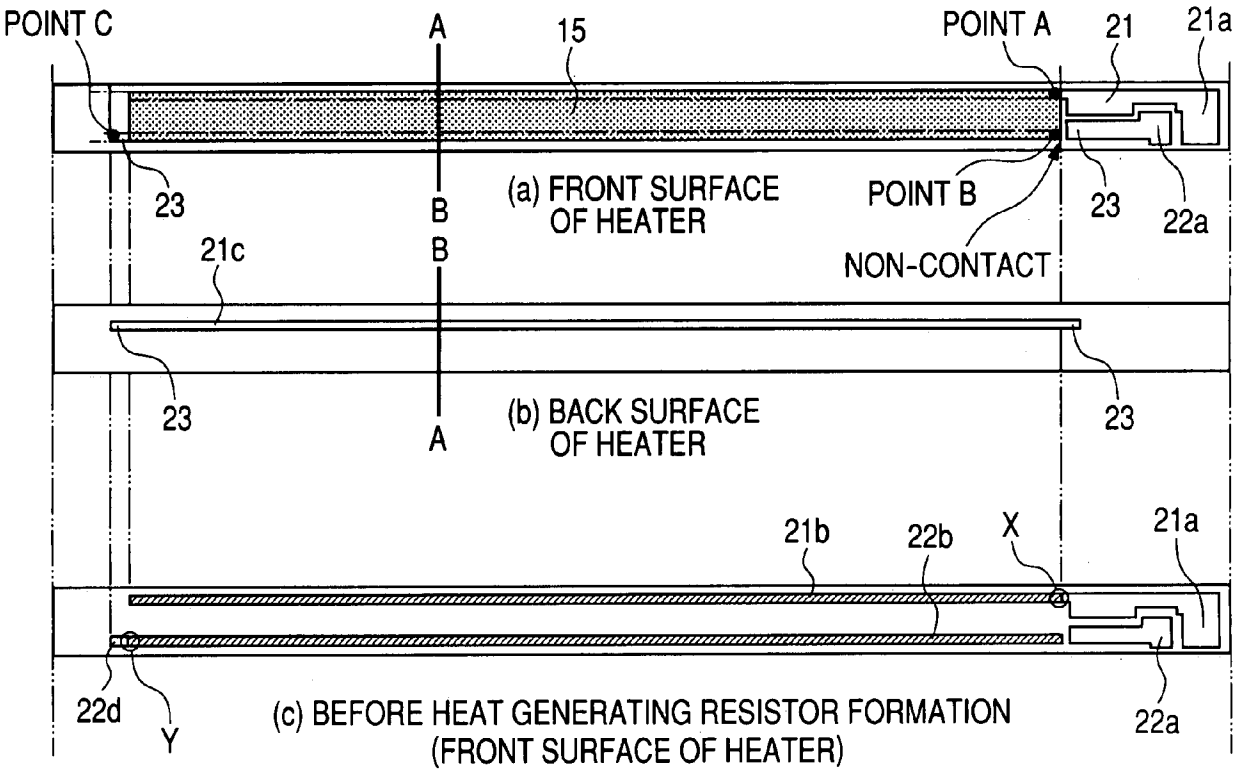
FIG. 2 is a structural view showing a heat generating resistor pattern and an electrode pattern of a heater constituting an embodiment 1 of the invention.

In FIG. 2, (a) and (b) are magnified-views respectively of a front surface and a rear surface of the heater 13 in the image heating apparatus of the present embodiment, and (c) is a view showing a state where electrodes are exposed prior to the formation of the heat generating resistor 15 on the substrate 14.

A substrate 14 is constituted for example of a ceramic material excellent in heat resistance and insulating property. The present embodiment employs an alumina substrate. The substrate 14 has a length of about 270 mm, a width of 10 mm and a thickness of about 1 mm. Electrodes 21, 22 are formed on the substrate 14 for example by screen printing thereon a paste formed by mixing glass powder in an electrically conductive material such as Ag or Ag/Pt. A volumic resistivity of the electrode can be regulated by changing the composition of the conductive material and the glass powder.

The electrode 21 (first electrode) is provided on a front surface (in contact with the fixing film) of the substrate 14 and at an upstream side in the conveying direction of the recording material, and includes a first area 21*a* to be in contact with a power supplying connector (not shown) of the main body of the printer and a second area 21*b* (represented by a thick black line in (c) of FIG. 2) provided at an end electrically opposite to the first area 21*a*. In (c) of FIG. 2, the second area is represented by a thick black line for the purpose of clarity, but the second area in the present embodiment is of a same material as in other areas of the electrode. This applies also to the second electrode explained in the following.

The electrode 22 (second electrode) is provided at a downstream side in the conveying direction of the recording material, and includes a first area 22*a* to be in contact with a power supplying connector (not shown) of the main body of the printer and a second area 22*b* (represented by a thick black line in (c) of FIG. 2) provided at an end electrically opposite to the first area 22*a*. The second area 22*b* of the electrode 22 is connected with an extended electrode portion 22*d*. The electrode 22 further includes a portion 22*c*, between the first area 22*a* and the second area 22*b*, formed on a rear side of the substrate 14 via a throughhole 23 formed in the substrate 14. The electrode paste is also filled in the throughhole 23.

As shown in FIG. 2, the second areas 21*b*, 22*b* of the electrodes 21, 22 are provided along the longitudinal direction of the substrate 14.

In the electrodes 21, 22, the first area and the second area may be formed with a same material, or may be formed with different materials. In the present embodiment, all the areas are made with a same material.

In the electrodes 21, 22 of the present embodiment, the second areas 21*b*, 22*b* have a length of about 220 mm, a width of about 1 mm and a thickness of about several tens of microns. In the electrode 22, the second area 22*b* is adjacent to the extended area 22*d* in which the throughhole 23 is formed.

A heat generating resistor 15 is formed on the substrate 14 for example by screen printing thereon a paste formed by mixing glass powder in an electrically resistant material such as Ag/Pd (silver palladium). The heat generating resistor 15 is printed on the electrodes 21, 22 so as to electrically connect the second area 21*b* of the electrode 21 and the second area 22*b* of the electrode 22. The heat generating resistor 15 has a PTC property. The heat generating resistor 15 has a length of about 220 mm, same as that of the second areas 21*b*, 22*b* of the electrodes 21, 22, a width of about 7 mm and a thickness of about several tens of microns. Also in the heat generating resistor, a volumic resistivity can be regulated by changing the composition of the constituting materials.

By positioning the first areas 21*a*, 22*a* of the electrodes 21, 22 at an end portion of the substrate as shown in FIG. 2, it is rendered possible to simplify the structure of a connector to be connected to the electrodes and to efficiently position the heat generating resistor 15 within the heater substrate 14. However, an electrode part 22*c* need not necessarily be positioned on the rear surface of the substrate 14 by forming the throughhole 23 but may be formed on the front surface of the substrate. Based on the foregoing, the shape of the heat generating resistor and the electrodes explained in the present invention will be hereinafter called, for the purpose of simplicity, "a sheet-passing-direction current-feed type".

Within the electrode of the present invention, the second area means an area which generates a voltage drop influencing the distribution of heat generation of the heat-generating resistor, and, for example in the present embodiment, an area contacted by the heat generating resistor 15 (portion indicated by a thick black line in (c) of FIG. 2) corresponds to the second area. Therefore, the part 22*c* or the extended area 22*d* of the second electrode 22 is not included in the second area.

Figure 10:
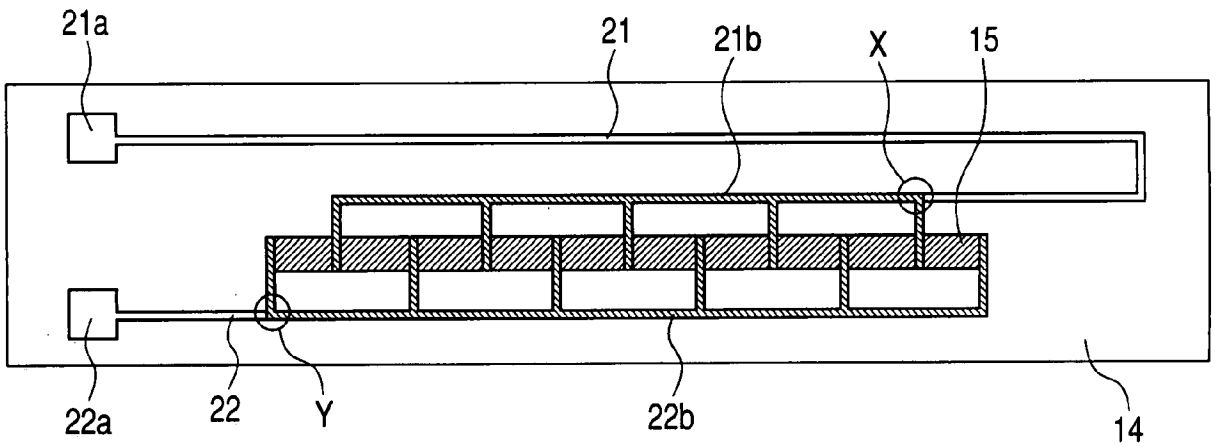
FIG. 10 is a view showing an example of a heater of sheet-passing-direction current-feed type.

Also as an example of the sheet-passing-direction current-feed type, there can be conceived a structure as shown in FIG. 10, in which components of like functions are represented by like numbers. Plural heat generating resistors 15 connected between electrodes 21 and 22 are arranged along the longitudinal direction of the substrate 14. The electrodes 21, 22 include first areas 21*a*, 22*a* to be in contact with an unillustrated power supplying connector, and second areas 21*b*, 22*b* represented by thick black lines in FIG. 10. Within the electrode, an area represented by a thick black line generates a voltage drop influencing the distribution of heat generation of the heat-generating resistor 15. The second areas are arranged along the longitudinal direction of the substrate. In the heater shown in FIG. 2, all the second areas of the electrodes are in contact with the heat generating resistor, but, in the heater shown in FIG. 10, only parts of the second areas 21*b*, 22*b* are in contact with the heat generating resistor 15.

Both in the heaters shown in FIGS. 2 and 10, within the second area 21*b* of the first electrode 21, a portion electrically closest to the first area 21*a* of the first electrode 21 (namely a portion X in FIGS. 2 and 10) is provided in the vicinity of an end (right-hand end in FIGS. 2 and 10) of the substrate 14 in the longitudinal direction thereof, and, within the second area 22*b* of the second electrode 22, a portion electrically closest to the first area 22*a* of the second electrode 22 (namely a portion Y in FIGS. 2 and 10) is provided in the vicinity of the other end (left-hand end in FIGS. 2 and 10) of the substrate 14 in the longitudinal direction thereof. Thus, both in the heaters shown in FIGS. 2 and 10, current entrances from the electrodes to the heat generating resistor are separated at both end portions of the substrate in the longitudinal direction thereof.

In the following, there will be explained a current supply direction for the heater.

Figure 7:
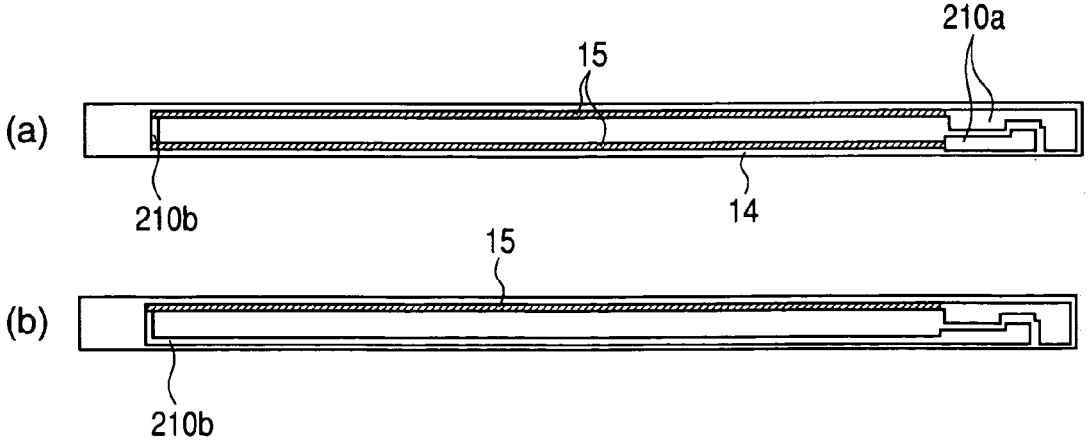
FIG. 7 is a view showing a heat generating resistor pattern and an electrode pattern of a prior heater.
Figure 8:
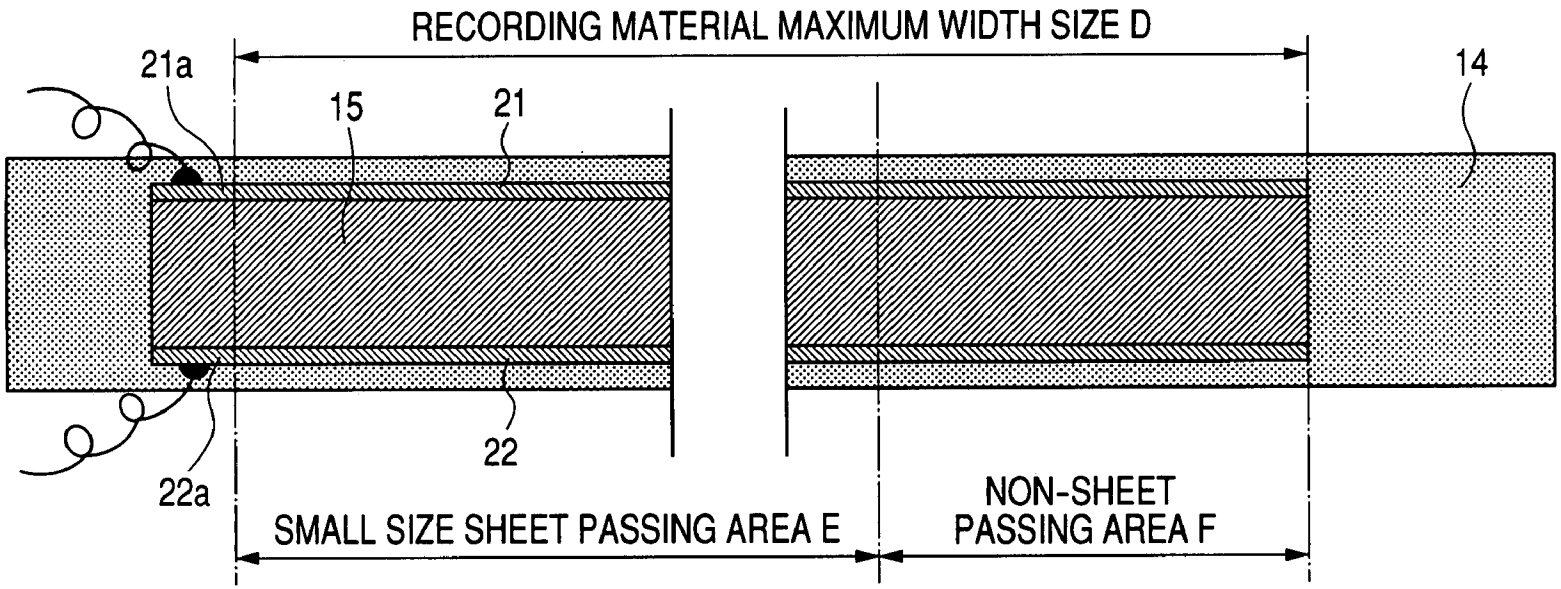
FIG. 8 is a view showing an example of a heater of sheet-passing-direction current-feed type.
Figure 9:
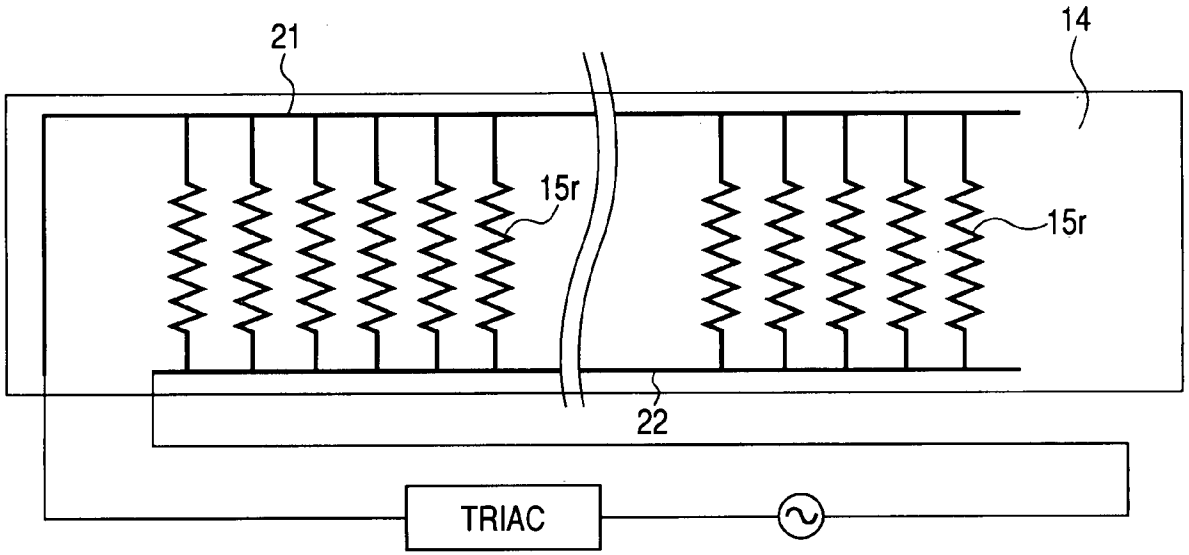
FIG. 9 is an electrical circuit diagram of the heater shown in FIG. 8.

In a prior configuration as shown in FIG. 7, in which a heat generating member 15 is provided in a reciprocating structure in the longitudinal direction of the substrate 14, namely a resistor is simply connected between two electrodes, in passing a small-sized sheet, a sheet passing area shows a temperature decrease because the heat is taken away by the sheet, while a sheet non-passing area shows a temperature increase because the heat is not taken away by the sheet. This is because the heat generating member, usually having a PTC property, shows an increase in the resistance by the heat generation.

On the other hand, in a heater of the sheet-passing-direction current-feed type as in the present embodiment, even with a heat generating member of a similar PTC property, the current flows not only in the longitudinal direction of the heater substrate 14 but also in the sheet passing direction, whereby the current is suppressed in the heat generating member of a temperature elevating area such as a sheet non-passing area but tends to flow in the heat generating member 15 in the sheet passing area where the temperature does not increase. Thus there can be obtained characteristics of suppressing an excessive temperature increase in the sheet non-passing area while securing a current supply state in the sheet passing state. Such characteristics are more enhanced as the PTC property becomes larger.

However, in the pattern shown in FIG. 2, in case the electrode and the heat generating member are relatively close in the volumic resistivity, there results a phenomenon that, when a sheet is not passed in the fixing nip, the current passing amount does not become uniform over the entire surface of the heat generating member 15 but becomes larger at both end portions in the longitudinal direction of the substrate than in a central portion whereby the heat generation becomes larger in the both end portions than in the central portion. This is because the electrode has a certain resistance to generate a voltage drop within the electrode, whereby, even within the same electrode, the current flowing into the heat generating member decreases with an increase in the distance from the current entrance. In the configuration of the present embodiment where the current entrances are positioned on both ends in the longitudinal direction of the substrate, the center of the heat generating resistor member in the longitudinal direction is farthest from the current entrance while the both ends of the heat generating resistor member is closest to the current entrance, so that the heat generation becomes larger at both ends and smaller in the central portion when the voltage drop by the resistance value of the electrode is unnegligible.

Such distribution of the heat generation amount higher in the both end portions than in the central portion in the longitudinal direction of the substrate in a sheet non-passing state leads to defects such as an uneven fixing, a defective fixing, a hot offset, a heater cracking etc. induced by such uneven heat generation.

Such phenomenon is generated when the resistance of the second area of the electrode is unnegligible in comparison with the resistance of the heat generating member 15.

In the present embodiment, therefore, the heat generating resistor member and the electrodes are maintained at length, width and thickness as shown in FIG. 2, while the volumic resistivity of the electrodes and that of the heat generating resistor member are selected at a ratio in excess of 100,000 times, thereby rendering the resistance value f the electrodes, particularly in the second area, negligible in comparison with the resistance value of the heat generating resistor member. In this state, the resistances at points A, B and C are so selected as to provide a resistance ratio (section B-A)/(section C-A) of 99.97%.

As regards the details of the points A, B and C, in a state where the heat generating resistor 15 is formed on the first electrode 21 and the second electrode 22, a measuring point A is defined at a position of 2 mm inside the first area, while a measuring point B is defined at a position of 2 mm outside the end of the second area and on a longitudinally outward extension of the second area of the second electrode, and a measuring point C is defined at a position of 2 mm outside the end of the second area and on a longitudinally outward extension of the second area of the second electrode. A more accurate measurement would be possible at an end of the second area of each electrode (for example an end position Y instead of the point C). In the present embodiment, however, the error is negligible since the extension of the electrode is as short as 2 mm.

In the configuration of the heater in which the current entrances to the heat generating resistor are separated at both ends of the substrate as shown in FIG. 2, the resistance ratio (section B-A)/(section C-A) has to be 99.97% or higher when the heater temperature is at the set temperature in the fixing process.

This resistance ratio is applicable state where the heater temperature is at the set temperature in the fixing process (image heating process). As explained in the foregoing, the set temperature in the fixing process is provided in plural levels, but it is preferable that the aforementioned resistance ratio is satisfied in all the set temperatures selected in a printer (fixing apparatus). The resistance ratio of (section B-A)/(section C-A) is defined because (section B-A) and (section C-A) will have a same resistance value in case the electrode has an infinitely small resistance value, and the resistance value of (section C-A) becomes higher than the resistance value of (section B-A) when the resistance value of the electrode becomes larger.

Thus, such configuration allows to obtain a substantially uniform current over the entire area of the heat generating member 15, thereby providing a uniform distribution of heat generation.

Figure 4:
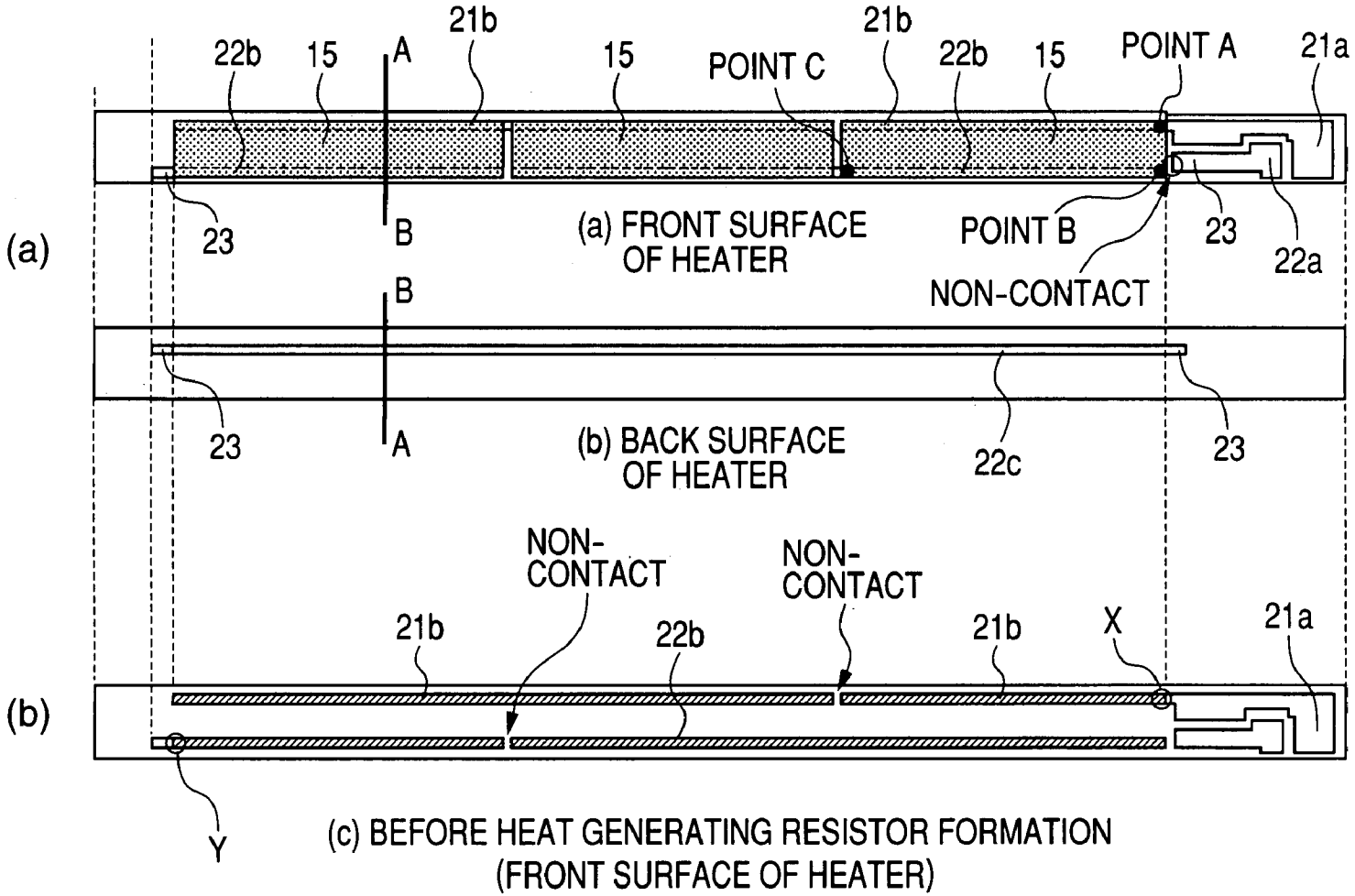
FIG. 4 is a structural view showing a heat generating resistor pattern and an electrode pattern of a heater in a variation of the embodiment 1.

The resistance ratio of (section B-A)/(section C-A) is selected at about 99.97%, but a better result can naturally be obtained at a value higher than 99.97%. Also in the configuration of the heater substrate of the present embodiment, the aforementioned resistance ratio is regulated by the volumic resistivities of the heat generating member 15 and the electrodes 21, 22, but a similar effect can also be realized by a pattern such as width, thickness and length of the heat generating member and the electrodes. Furthermore, a similar effect can be obtained by dividing the second area of the electrodes and the heat generating resistor in plural portions in the longitudinal direction and connecting the neighboring electrode portions in a staggered manner as shown in FIG. 4, by setting a resistance ratio of (section B-A)/(section C-A) at points A, B and C defined as shown in FIG. 4 at the aforementioned value.

The present embodiment has been explained principally by constituting a heater only by a current passing pattern in the sheet passing direction, but a similar effect can also be obtained by combining such pattern with a pattern in which the heat generating member is reciprocated in the longitudinal direction of the heater.

In the following, a heater of the present embodiment will be compared with a heater with a prior reciprocating pattern of heat generating member.

Figure 3:
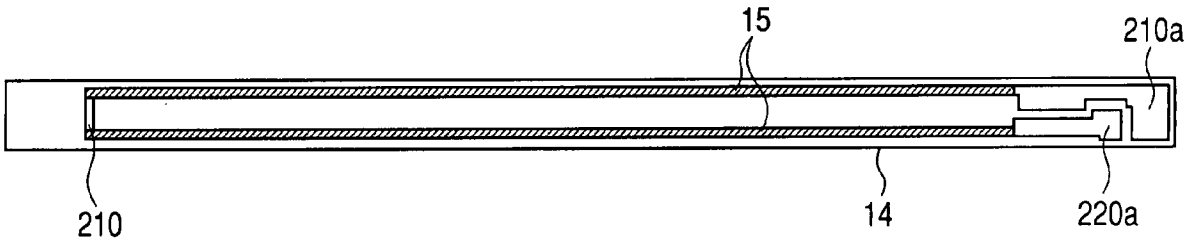
FIG. 3 is a view showing a heat generating resistor pattern and an electrode pattern of a heater employed as a comparative example to the embodiment 1.

The reciprocating pattern of the heat generating member taken as a prior example was that described in FIG. 3. The heater substrate 14 had a width of about 10 mm, and the heat generating resistor had a longitudinal length of about 220 mm. On the heater substrate 14, electrode portions 210*a*, 220*a* to be in contact with a power supplying connector were provided at a side portion, beyond which heat generating members 15 of a width of about 1 mm were provided in a reciprocating pattern. The heat generating member 15 had a thickness of several tens of microns, and the electrodes and the heat generating member 15 had approximately same thicknesses. A low-resistance conductive portion 210, connecting two heat generating resistors 15 was made of a material same as that for the portions 210*a*, 220*a*.

The surface temperature of the pressure roller was compared between a sheet non-passing portion and a sheet passing portion in the longitudinal direction of the heater, when such heaters were incorporated in the fixing device and sheets were passed through the fixing nip.

Temperature was measured after successively passing 10 postcards in an environment of a temperature of 23° C. and a humidity of 50%. The surface temperature of the pressure roller was measured by contacting a felt material formed by heat resistant fibers with the pressure roller and positioning a thermocouple between the pressure roller and the felt material. The heater was controlled by positioning a thermistor on the rear surface of the heater in the sheet passing area and controlling the power supply to the heat generating resistor in such a manner that the temperature detected by the thermistor is maintained at a set temperature (180° C.). Also the temperature control on the heaters was so regulated as to obtain a constant fixing property on the postcards.

Results of comparison are shown in following

TABLE 1

Comparison of surface temperature of pressure roller

| | Surface temperature of pressure roller in sheet passing portion (° C.) | Surface temperature of pressure roller in sheet non-passing portion (° C.) | Temperature difference (° C.) |
|---|---|---|---|
| Prior example | 140 | 230 | 90 |
| Embodiment 1 | 140 | 180 | 40 |

In the prior configuration, the pressure roller showed a surface temperature of 140° C. in the sheet passing area, and in this state a surface temperature of 230° C. in the sheet non-passing area. In comparison with the sheet passing area, the sheet non-passing area showed a temperature increase of about 164%.

On the other hand, in the configuration of the present embodiment, the pressure roller showed a surface temperature of 140° C. in the sheet passing area, and in this state a surface temperature of 180° C. in the sheet non-passing area. The temperature ratio between the sheet passing area and the sheet non-passing area was reduced to 129%. Also the temperature difference between the sheet passing area and the sheet non-passing area was 90° in the prior configuration and 40° in the present embodiment, thus achieving a margin increase of 60° on the temperature difference between the sheet passing area and the sheet non-passing area.

In the following there are shown results of unevenness in the heat generation, measured by thermography, on each of a single heater of the present embodiment as shown in FIG. 2 having a resistance ratio (section,B-A)/(section C-A) selected at 99.97%, and a single heater of a comparative example having a structure same as in FIG. 2 but having a resistance ratio (section B-A)/(section C-A) selected at 99.90%, when the power supply is so controlled as to obtain a temperature of 200° C. at the center of the heater. The unevenness in the heat generation was compared by measuring a highest temperature and a lowest temperature on the heat generating member of the heater and comparing the difference thereof. The comparison was made in a state when the recording sheet was not passed.

TABLE 2

Comparison of uniformity of heat generation in the configurations of the present embodiment and the comparative example

| | Highest temp. (° C.) | Lowest temp. (° C.) | Unevenness in temp. (° C.) |
|---|---|---|---|
| Comp. example | 224 | 200 | 24 |
| Present embodiment | 209 | 200 | 10 |

As shown in the table, even in the heaters of the sheet-passing-direction current-feed type of a same structure, a resistance ratio (section B-A)/(section C-A) selected at 99.97% or higher as in the present embodiment allows to provide a significantly more uniform distribution of the heat generation in a single heater, in comparison with a heater of a resistance ratio less than 99.97%. These results indicate that the heater of the present embodiment allows to decrease the unevenness in the temperature distribution in the sheet non-passing state in the fixing nip.

The configuration of the present embodiment explained in the foregoing allows, in case of passing small-sized sheets such as postcards in the fixing device, to decrease the temperature difference between the sheet passing area and the sheet non-passing area in the longitudinal direction of the fixing device, thereby suppressing the loss of output per unit time in a printing operation on the small-sized sheets. It can also reduce the unevenness in the temperature distribution in the sheet non-passing state in the fixing nip, thereby suppressing the uneven fixation in fixing a recording sheet of a maximum size usable in the printer.

The present embodiment has been explained by a heat-pressure fixing apparatus of film drive system, but a similar structure may also be adopted in other fixing apparatuses. Also the heater is provided on a flat substrate, but a similar effect can be obtained in a configuration having a heater in the film portion of the present embodiment. Also in the present embodiment, the heat generating member is provided on a side of the heater substrate opposed to the film, but a similar effect can also be obtained by providing the heat generating member at a rear side.

(Embodiment 2)

In the embodiment 1, as explained in the foregoing, within the second area 21*b* of the first electrode 21, a portion electrically closest to the first area 21*a* of the first electrode 21 (a portion X in FIG. 2) is provided in the vicinity of an end (right-hand end in FIG. 2) of the substrate 14 in the longitudinal direction thereof, and, within the second area 22*b* of the second electrode 22, a portion electrically closest to the first area 22*a* of the second electrode 22 (a portion Y in FIG. 2) is provided in the vicinity of the other end (left-hand end in FIG. 2) of the substrate 14 in the longitudinal direction thereof. Thus, in the heater of the embodiment 1, the current entrances from the electrodes to the heat generating resistor are separated at both ends of the substrate in the longitudinal direction thereof.

On the other hand, in the embodiment 2, within the second areas 21*b*, 22*b* of the first electrode 21 and the second electrode 22, portions electrically closest to the first areas 21*a*, 22*a* are both provided in the vicinity of an end of the substrate 14 in the longitudinal direction thereof. Stated differently, in the heater of the embodiment 2, the current entrances from the electrodes to the heat generating resistor are both positioned at a same side of the substrate in the longitudinal direction thereof.

Figure 5:
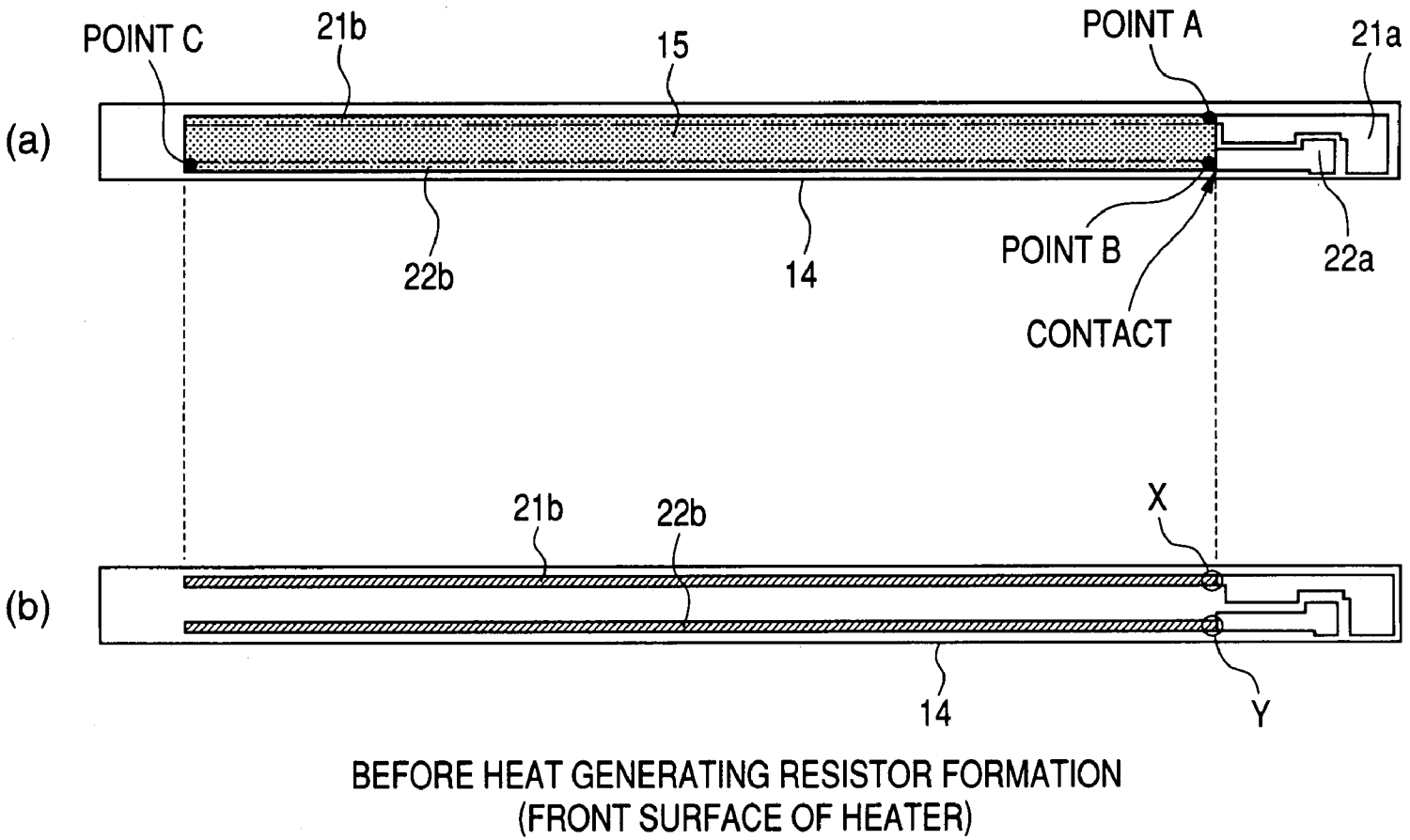
FIG. 5 is a structural view showing a heat generating resistor pattern and an electrode pattern of a heater constituting an embodiment 2 of the invention.
Figure 6:
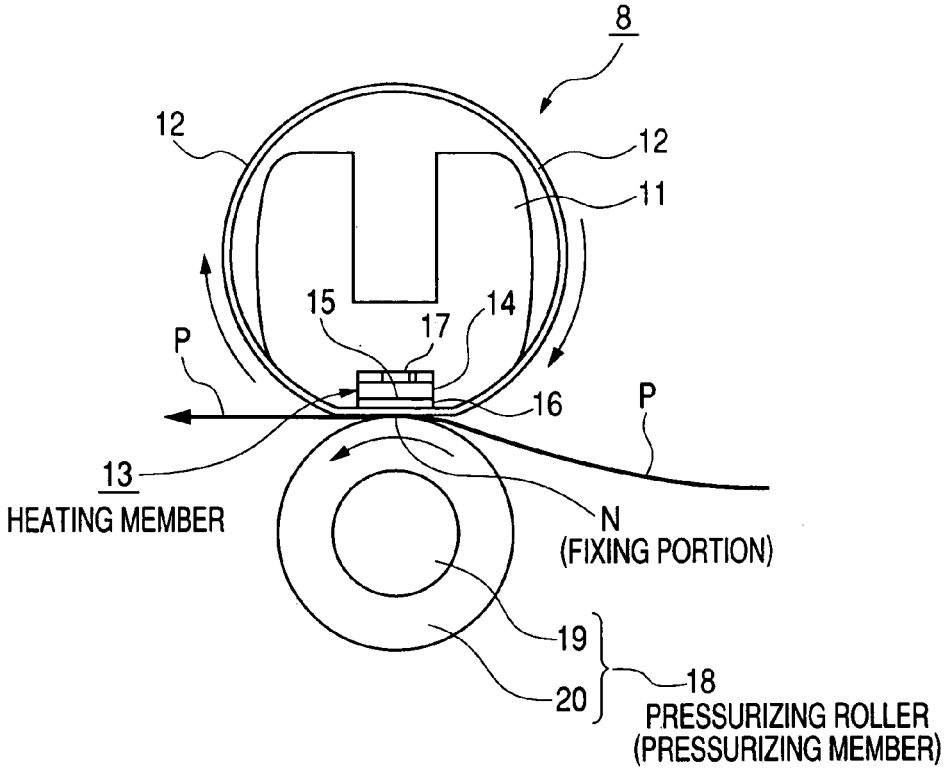
FIG. 6 is a schematic view showing a configuration of a prior fixing apparatus.

FIG. 5 shows a heater of the present embodiment. The embodiment 2 is also a heater of a sheet-passing-direction current-feed type, and the second areas 21*b*, 22*b* of the two electrodes 21, 22 are both arranged along the longitudinal direction of the substrate 14. Also the heat generating resistor 15 is so provided as to electrically connect the second area 21*b* of the first electrode 21 and the second area 22*b* of the second electrode 22.

In case of the heater shown in FIG. 5, since the current entrances from the electrodes to the heat generating resistor are both positioned at a same side of the substrate in the longitudinal direction thereof, the current tends to flow more in the vicinity of such entrance, and the heat generation tends to become higher at an end side in the longitudinal direction (right-hand side in FIG. 5) and lower at the other side (left-hand side in FIG. 5).

Therefore, also in the present embodiment, a resistance ratio (section B-A)/(section C-A) was so selected that the resistance values of the second areas of the electrodes are practically negligible when the heater is at the set temperature in the fixing process.

In the present embodiment, the resistances at points A, B and C are so selected as to provide a resistance ratio (section B-A)/(section C-A) of 99.99%. In the heater shown in FIG. 5, since the current entrances from the electrodes to the heat generating resistor are both at a same side of the substrate in the longitudinal direction, the resistance ratio has to be set more strictly than in the heater of the embodiment 1. In a configuration where the current entrances from the electrodes to the heat generating resistor are both at a same side of the substrate in the longitudinal direction as shown in FIG. 5, the resistance ratio of (section B-A)/(section C-A) has to be 99.99% or higher when the heater temperature is at the set temperature in the fixing process.

In the present embodiment, the electrodes and the heat generating resistor have sizes approximately same as those in the embodiment 1, and the aforementioned resistance ratio is attained by a ratio of volumic resistivity of the electrodes and the heat generating resistor in excess of 100,000 times. Also a similar effect can be obtained by realizing such resistance ratio by a pattern of width, thickness and length of the heating generating member and the conductors.

In the following, effects of the present embodiment will be explained.

As comparative examples, there were employed heaters with a resistance ratio (section B-A)/(section C-A) of 99.8% and 99.97% (same as in the embodiment 1). These heaters had a configuration shown in FIG. 5, with the current entrances at an end portion of the substrate. On the other hand, the heater of the present embodiment had a configuration shown in FIG. 5 with a resistance ratio of (section B-A)/(section C-A) of 99.99%. These resistances were obtained by regulating the volumic resistivity of the heat generating resistor.

Each single heater was subjected to a current supply control so as to obtain a temperature of 200° C. at the center of the heater, and an unevenness in the heat generation was measured by thermography, in a sheet non-passing state. Results are shown in the following. The unevenness in heat generation was compared by measuring temperatures of the heat generating member of the heater at positions of 15 mm inside from both ends in the longitudinal direction, and determining the difference.

Results of comparison are shown in Table 3.

TABLE 3

| | comparison of unevenness in heat generation of heater | | | |
|---|---|---|---|---|
| Resistance ratio (B-A)/(C-A) | Surface temp. of heat generating member (° C.) (right side in FIG. 5) | Surface temp. of heat generating member (° C.) (left side in FIG. 5) | Temperature difference (° C.) | Remarks |
| 99.8% | 240 | 130 | 110 | large temp. difference |
| 99.97% | 190 | 170 | 20 | large temp. difference |
| 99.99% (present embodiment) | 185 | 175 | 10 | OK |

As shown in the table, even in the heaters of the sheet-passing-direction current-feed type as shown in FIG. 5, the unevenness in the heat generation is dependent significantly on the resistance ratio (section B-A)/(section C-A). This is because, in case the electrode has a large resistance and the voltage drop in the electrode is unnegligible, the current flowing into the heat generating resistor decreases as the distance from the current entrance increases.

It can however be observed that the distribution of heat generation of the single heater can be made significantly uniform by selecting the resistance ratio (section B-A)/(section C-A) at 99.99% or higher. It is thus identified that the heater of the present embodiment allows to reduce the unevenness in the temperature distribution in the state where the sheet is not passed through the fixing nip.

An unevenness in the heat generation of the heat generating resistor of 10° C. or less, as in the present embodiment, is practically acceptable for executing a uniform fixation. The unevenness in the heat generation is preferably 10° C. or less, as an unevenness exceeding 10° C. may cause a drawback. Therefore, in a heater in which the current entrances to the heat generating resistor are both positioned at a side of the substrate as shown in FIG. 5, the resistance ratio (section B-A)/(section C-A) is preferably selected at 99.99% or higher.

As stated in the embodiments 1 and 2, by selecting the resistance ratio (section B-A)/(section C-A) in such a manner that the resistance values of the second areas of the electrodes are negligible in a state where the heater is at the set temperature for the fixing process, it is possible to suppress an unevenness in the temperature distribution of the heater when the recording material is not conveyed, while exploiting the advantages of the heater of sheet-passing-direction current-feed type.

However, in the heater of the embodiment 1, the resistance ratio (section B-A)/(section C-A) has to be selected as 99.97% or higher, and, in the heater of the embodiment 2, the resistance ratio has to be selected more strictly as 99.99% or higher. Such resistance ratio is very difficult to set at the points A-C shown in the embodiments 1 and 2.

Therefore, following embodiments 3 and 4 show a method of setting the resistance ratio more easily than in the embodiments 1 and 2.

(Embodiment 3)

In the following, there will be explained a third embodiment of the present invention.

Figure 13:
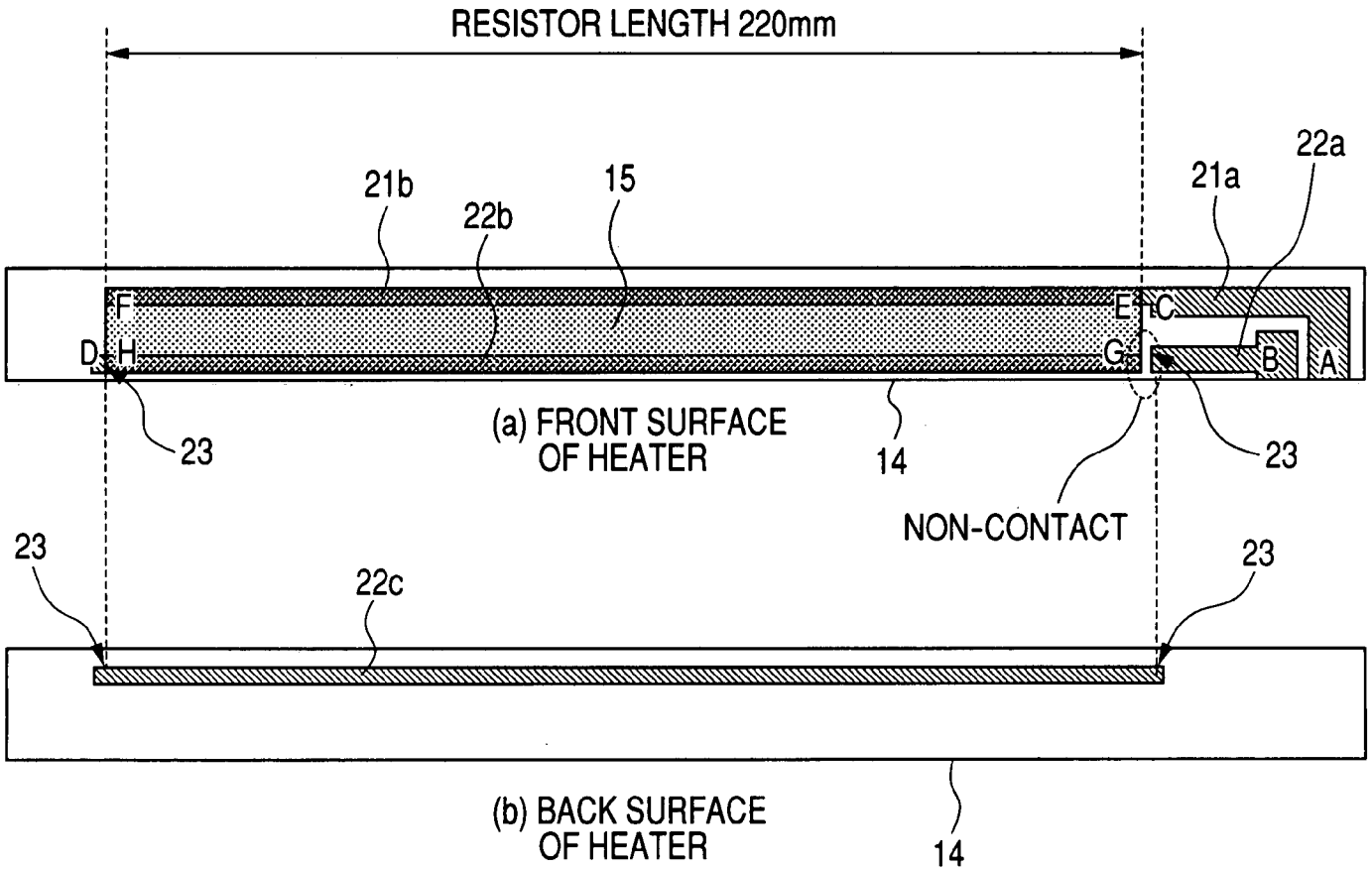
FIG. 13 is a structural view showing a heat generating resistor pattern and an electrode pattern of a heater constituting an embodiment 3 of the invention.

In FIG. 13, (a) and (b) are magnified views respectively of a top surface and a rear surface of a heater 13 in an image heating apparatus of the present embodiment. On a substrate 14, electrodes and a heat generating resistor have shapes and functions basically same as those in the embodiment 1 shown in FIG. 2.

In the present embodiment, there is defined a relationship between a resistance value Rt (hereinafter called total resistance value) from a portion, within the second area of the first electrode, electrically closest to the first area of the first electrode, to a portion, within the second area of the second electrode, electrically closest to the first area of the second electrode, and a resistance value Rc of the second area of an electrode.

As already explained in the embodiment 1, when the heater is at the set temperature (fixing temperature) of the fixing process and in case the resistance value of the second area of the electrode is unnegligible with respect to the resistance value of the heat generating resistor, the heat generation of the heater tends to become larger at end portions in the longitudinal direction, even when the sheet is not passed in the fixing nip.

Therefore, plural heaters were prepared by forming the electrodes and the heat generating resistor in a print pattern as shown in FIG. 13 and changing the thickness and the material composition of the heat generating resistor 15, and a resistance ratio and a temperature difference between the center and the end portions were investigated on each heater.

(Heater 1: Present Embodiment)

A paste for forming the heat generating resistor had a Pd content of 15% and was screen printed to form a heat generating resistor of a thickness of 7 μm. The electrodes 21, 22, formed on the substrate 14 prior to the printing of the heat generating resistor had a thickness of 7 μm both in the first areas 21*a*, 22*a* and the second areas 21*b*, 22*b*.

(Heater 2: Present Embodiment)

A paste for forming the heat generating resistor was same as in the heater 1 and was screen printed to form a heat generating resistor of a thickness of 11 μm. The electrodes 21, 22, formed on the substrate 14 prior to the printing of the heat generating resistor had a thickness of 25 μm both in the first areas 21*a*, 22*a* and the second areas 21*b*, 22*b*.

(Heater 3: Comparative Example 1)

A paste for forming the heat generating resistor had a Pd content of 55% and was screen printed to form a heat generating resistor of a thickness of 25 μm. The electrodes 21, 22, formed on the substrate 14 prior to the printing of the heat generating resistor had a thickness of 7 μm both in the first areas 21*a*, 22*a* and the second areas 21*b*, 22*b*.

(Heater 4: Comparative Example 2)

A paste for forming the heat generating resistor was same as in the heater 3 and was screen printed to form a heat generating resistor of a thickness of 25 μm. The electrodes 21, 22, formed on the substrate 14 prior to the printing of the heat generating resistor had a thickness of 25 μm both in the first areas 21*a*, 22*a* and the second areas 21*b*, 22*b*.

Table 4 shows the total resistance value Rt, the resistance value Rc of the second area of the electrode 21, the resistance ratio and the difference in heat generation in the current supply state for each heater. As explained before, the total resistance value Rt means a resistance value from a portion, within the second area of the first electrode, electrically closest to the first area of the first electrode, to a portion, within the second area of the second electrode, electrically closest to the first area of the second electrode. Also the resistance value Rc is a resistance value of the second area of an electrode.

The total resistance value Rt is obtained subtracting, from a resistance value measured between points A and B shown in FIG. 13 (measured resistance value A-B), a resistance value measured between points A and C (measured resistance value A-C) and a resistance value measured between points B and D (measured resistance value B-D) where the heat generating resistor 15 is not provided. These measurements were made before a glass layer was formed on the heat generating resistor 15. Also the resistance value Rc of the second area of the electrode was measured between points E-F and points G-H prior to the formation of the heat generating resistor 15, and a higher value was adopted.

The resistance value Rc of the second area of the electrode and the total resistance value Rt may also be measured after the formation of the heat generating resistor layer and the glass layer, by polishing the surface thereof to expose the electrode layer and utilizing such exposed portion for contacting a resistance meter, as the measured value is substantially same as the aforementioned measurement.

Figure 11:
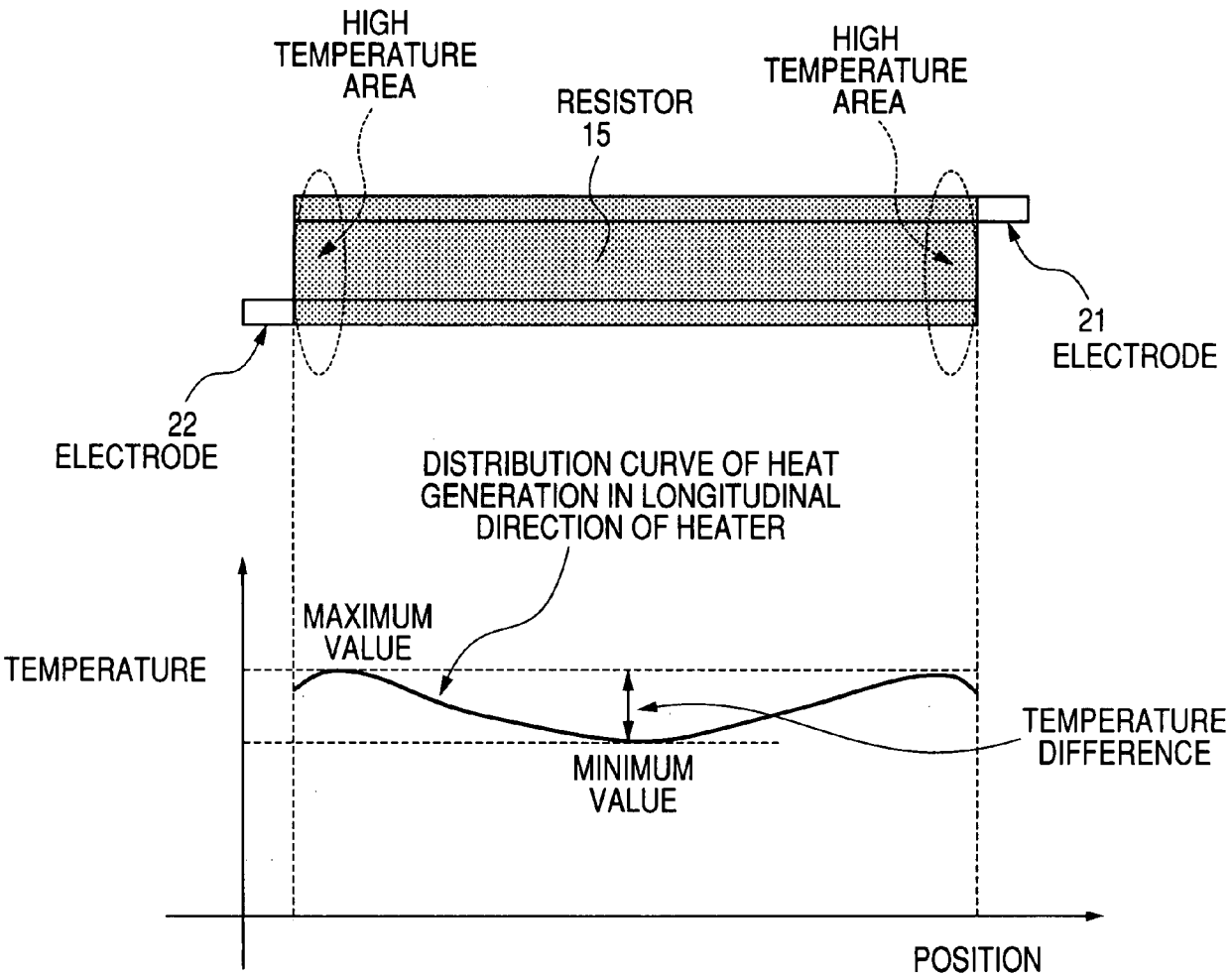
FIG. 11 is a view showing a distribution of heat generation with a heater of the type of embodiment 1.

The resistance value was measured in a state where the heater was not heated (normal temperature environment) under conditions of a room temperature of 23° C. and a humidity of 55%, and a state where the heater was heated to 200° C. (200° C. environment) in a room temperature of 23° C. and a humidity of 55%. The measurement at 200° C. was conducted by placing a single heater on a hot plate heated at 200° C. and the measurement was conducted after sufficient heating (10 minutes). Also the difference of heat generation was measured by controlling the current supply to a single heater so as to maintain a set temperature of 200° C., then a distribution of heat generation was measured with thermography, and a maximum difference between peaks of heat generation at both ends and a heat generation at the central portion was taken as shown in FIG. 11. Also the resistance ratio is defined as a resistance value of the second area of a single electrode when the total resistance value Rt is normalized to 1.

TABLE 4

Resistance ratio and difference in heat generation in heaters

| | Total resistance value Rt at normal temp. | Resistance value Rc of second area of electrode at normal temp. | Resistance ratio Rc/Rt at normal temp. | Total resistance value Rt at 200° C. | Resistance value Rc of second area of electrode at 200° C. | Resistance ratio Rc/Rt at 200° C. | Difference in heat generation (end - center) |
|---|---|---|---|---|---|---|---|
| Heater 1 (embodiment) | 20 Ω | 0.7 Ω | 1/28.5 | 30 Ω | 1.0 Ω | 1/30 | 10° C. |
| Heater 2 (embodiment) | 12 Ω | 0.3 Ω | 1/40 | 16 Ω | 0.4 Ω | 1/40 | 3° C. |
| Heater 3 (comp. ex. 1) | 11 Ω | 0.7 Ω | 1/15.7 | 11.5 Ω | 1.0 Ω | 1/11.5 | 25° C. |
| Heater 4 (comp. ex. 2) | 10.5 Ω | 0.3 Ω | 1/35 | 11.5 Ω | 0.4 Ω | 1/28.7 | 14° C. |

As will be apparent from the results of the heaters 1 and 2, the difference of heat generation was 10° C. or less in case the resistance ratio Rc/Rt was 1/30 or less at the fixing temperature of 200° C. The difference of heat generation of 10° C. or less is a practically acceptable level, and is preferably 10° C. or less, since a difference exceeding 10° C. may hinder a uniform fixation. It is also perceived that the temperature difference between the both ends and the central portion of the heater became smaller as the resistance ratio Rc/Rt decreased.

Also the results of the heaters 3 and 4 indicates that a resistance ratio Rc/Rt larger than 1/30 resulted in a difference of heat generation exceeding 10° C., and the temperature difference became larger as the resistance ratio Rc/Rt increased.

Also the results of the heater 1 indicate that a practically acceptable temperature difference of 10° C. could be obtained in case the resistance ratio Rc/Rt, even if 1/30 or higher at the normal temperature, was 1/30 or less at the fixing temperature of 200° C.

On the other hand, the results of the heater 4 indicate that the temperature difference undesirable exceeds 10° C. in case the resistance ratio Rc/Rt, even if 1/30 or lower at the normal temperature, was 1/30 or higher at the fixing temperature of 200° C.

In the present embodiment, the resistance value is measured in a state where the heater is heated at 200° C., but, as the set temperature in the fixing process is provided in plural levels as explained in the embodiment 1, it is preferable that the aforementioned resistance ratio is satisfied in all the set temperatures selected in a printer (fixing apparatus).

In the heater of sheet-passing-direction current-feed type of the invention, the heat generating resistor preferably has a large PTC property, which can be achieved by reducing a content of palladium in the paste for forming the resistor.

In the heaters 1–4 mentioned above, different resistance values were obtained by changing the thicknesses of the heat generating resistor and the electrodes and the volumic resistivity (Rd content) of the heat generating resistor, but it is also possible to obtain a desired resistance value by varying the width, length etc. of the heat generating resistor and the electrodes so as to obtain a resistance ratio Rc/Rt of 1/30 or less at the set temperature in the fixing process (image heating process).

Figure 14:
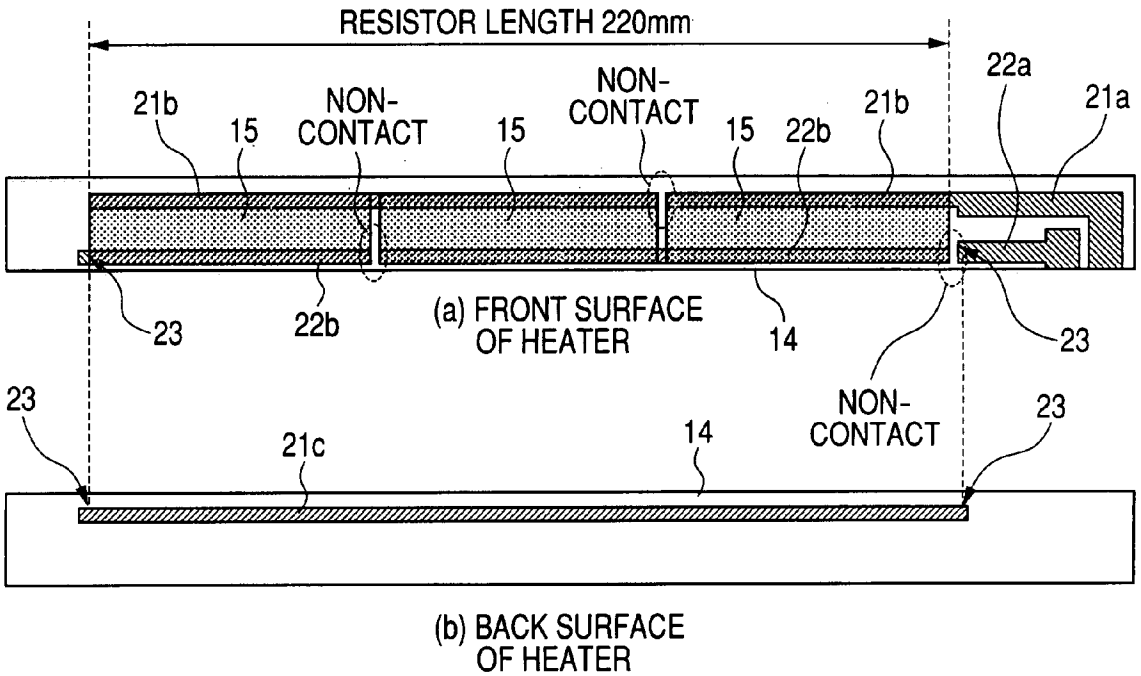
FIG. 14 is a structural view showing a heat generating resistor pattern and an electrode pattern of a heater in a variation of the embodiment 3.

Also a heater of a shape shown in FIG. 14, basically same in shape as the embodiment 1 shown in FIG. 4, may be employed by designing in such a manner that the resistance ratio Rc/Rt becomes 1/30 or less at the set temperature in the fixing process (image heating process).

(Embodiment 4)

Figure 15:
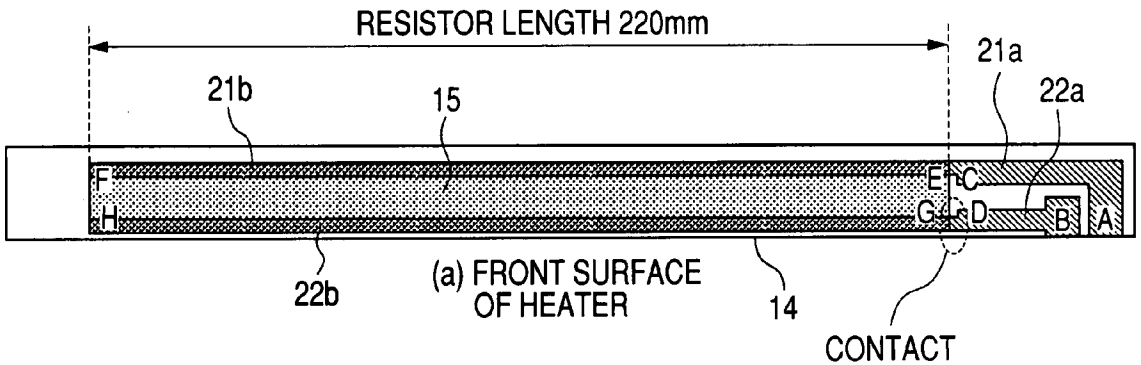
FIG. 15 is a structural view showing a heat generating resistor pattern and an electrode pattern of a heater constituting an embodiment 4 of the invention.

FIG. 15 is a magnified view of a top surface of a heater 13 in an image heating apparatus of the present embodiment. On a substrate 14, electrodes and a heat generating resistor have shapes and functions basically same as those in the embodiment 2 shown in FIG. 5. The embodiment 4 is also a heater of sheet-passing-direction current-feed type, and the second areas 21*b*, 22*b* of the two electrodes 21, 22 are both arranged along the longitudinal direction of the substrate 14. Also the heat generating resistor 15 is so provided as to electrically connect the second area 21*b* of the first electrode 21 and the second area 22*b* of the second electrode 22. Also within the second areas 21*b*, 22*b* of the first electrode 21 and the second electrode 22, portions electrically closest to the first areas 21*a*, 22*a* are both positioned in the vicinity of an end portion of the substrate 14 in the longitudinal direction thereof. Thus, in the heater of the embodiment 4, as in the embodiment 2, the current entrances from the electrodes to the heat generating resistor are both provided on a same side of the substrate in the longitudinal direction thereof.

Figure 12:
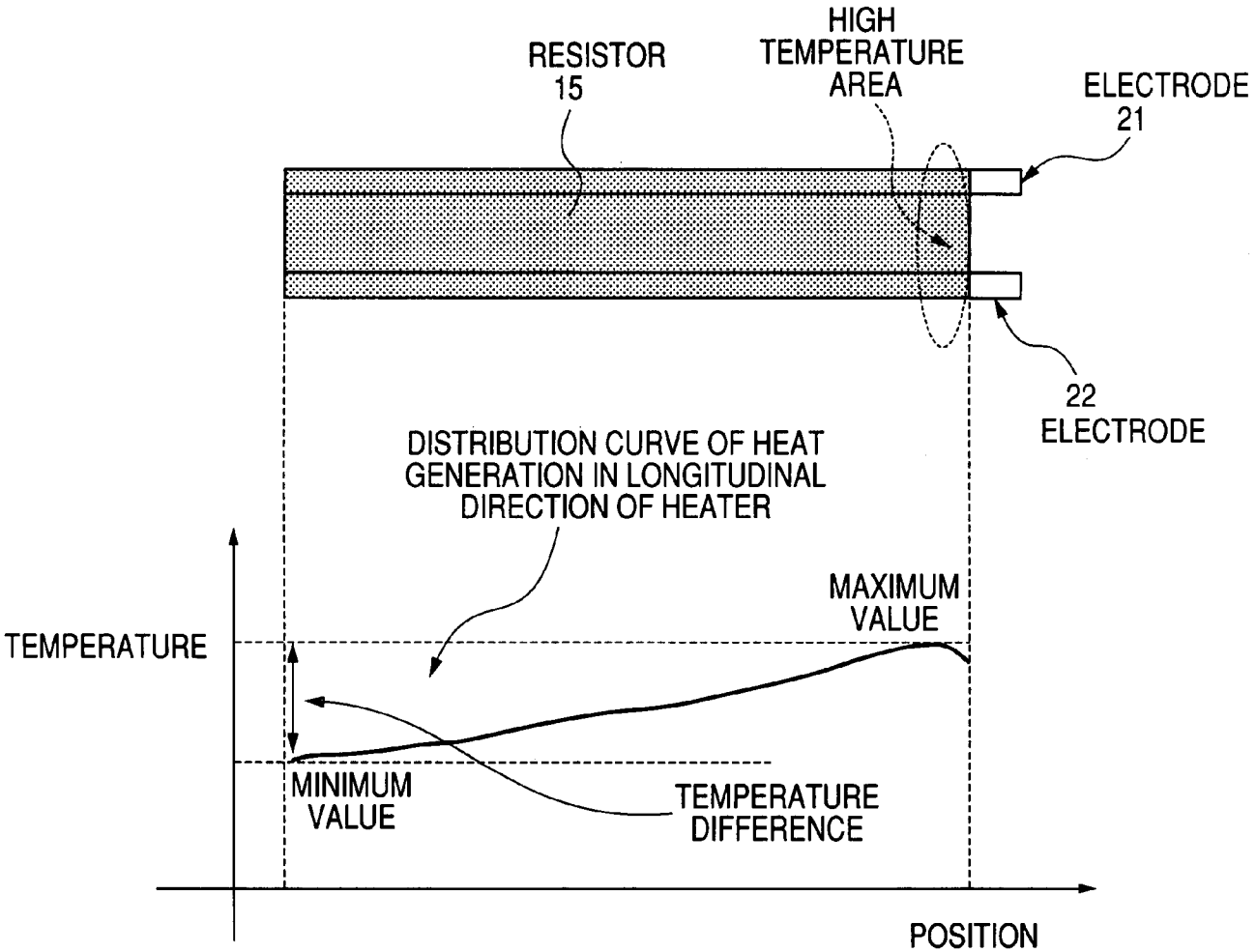
FIG. 12 is a view showing a distribution of heat generation with a heater of the type of embodiment 2.

As already explained in the embodiment 1, when the heater is at the set temperature for the fixing process (fixing temperature), in case the resistance value of the second area of the electrode is unnegligible with respect to the resistance value of the heat generating resistor, the heat generation tends to become higher in end portions of the heater in the longitudinal direction thereof even in a state where the sheet is not passed in the fixing nip. Thus, in the heater shown in FIG. 15, since the current entrances from the electrodes to the heat generating resistor are both positioned at a same side of the substrate in the longitudinal direction thereof, the current tends to flow more in the vicinity of such entrance, and the heat generation tends to become higher at an end side in the longitudinal direction (right-hand side in FIG. 15) and lower at the other side (left-hand side in FIG. 15), as shown in FIG. 12.

In the present embodiment, as in the embodiment 3, a total resistance value Rt and a resistance value Rc of the second area of an electrode are maintained at a relationship within a desired range, thereby suppressing the temperature difference between a sheet passing area and a sheet non-passing area in case of passing small-sized sheets and also suppressing the unevenness in the heat generation in a state where sheets are not passed.

Plural heaters were prepared by forming the electrodes and the heat generating resistor in a print pattern as shown in FIG. 15 and changing the thickness of the electrodes 21, 22 and the heat generating resistor 15 and the material composition of the heat generating resistor 15, and a resistance ratio and a temperature difference between the center and the end portions were investigated on each heater. in following heaters 5–8, the second area of the electrode had a doubled width in comparison with that in the embodiment 3.

(Heater 5: Present Embodiment)

A paste for forming the heat generating resistor had a Pd content of 15% and was screen printed to form a heat generating resistor of a thickness of 7 μm. The electrodes 21, 22, formed on the substrate 14 prior to the printing of the heat generating resistor had a thickness of 7 μm both in the first areas 21*a*, 22*a* and the second areas 21*b*, 22*b*.

(Heater 6: Present Embodiment)

A paste for forming the heat generating resistor was same as in the heater 5 and was screen printed to form a heat generating resistor of a thickness of 11 μm. The electrodes 21, 22, formed on the substrate 14 prior to the printing of the heat generating resistor had a thickness of 25 μm both in the first areas 21*a*, 22*a* and the second areas 21*b*, 22*b*.

(Heater 7: Comparative Example 3)

A paste for forming the heat generating resistor had a Pd content of 55% and was screen printed to form a heat generating resistor of a thickness of 25 μm. The electrodes 21, 22, formed on the substrate 14 prior to the printing of the heat generating resistor had a thickness of 7 μm both in the first areas 21*a*, 22*a* and the second areas 21*b*, 22*b*.

(Heater 8: Comparative Example 4)

A paste for forming the heat generating resistor was same as in the heater 3 and was screen printed to form a heat generating resistor of a thickness of 25 μm. The electrodes 21, 22, formed on the substrate 14 prior to the printing of the heat generating resistor had a thickness of 25 μm both in the first areas 21*a*, 22*a* and the second areas 21*b*, 22*b*.

Table 5 shows the total resistance value Rt, the resistance value Rc of the second area of the electrode 21, the resistance ratio and the difference in heat generation in the current supply state for each heater. As explained before, the total resistance value Rt means a resistance value from a portion, within the second area of the first electrode, electrically closest to the first area of the first electrode, to a portion, within the second area of the second electrode, electrically closest to the first area of the second electrode. Also the resistance value Rc is a resistance value of the second area of an electrode.

The total resistance value Rt is obtained subtracting, from a resistance value measured between points A and B shown in FIG. 13 (measured resistance value A-B), a resistance value measured between points A and C (measured resistance value A-C) and a resistance value measured between points B and D (measured resistance value B-D) where the heat generating resistor 15 is not provided. These measurements were made before a glass layer was formed on the heat generating resistor 15. Also the resistance value Rc of the second area of the electrode was measured between points E-F and points G-H prior to the formation of the heat generating resistor 15, and a higher value was adopted.

The resistance value Rc of the second area of the electrode and the total resistance value Rt may also be measured after the formation of the heat generating resistor layer and the glass layer, by polishing the surface thereof to expose the electrode layer and utilizing such exposed portion for contacting a resistance meter, as the measured value is substantially same as the aforementioned measurement.

The resistance value was measured in a state where the heater was not heated (normal temperature environment) under conditions of a room temperature of 23° C. and a humidity of 55%, and a state where the heater was heated to 200° C. (200° C. environment) in a room temperature of 23° C. and a humidity of 55%. The measurement at 200° C. was conducted by placing a single heater on a hot plate heated at 200° C. and the measurement was conducted after sufficient heating (10 minutes). Also the difference of heat generation was measured by controlling the current supply to a single heater so as to maintain a set temperature of 200° C., then a distribution of heat generation was measured with thermography, and a maximum difference between peaks of heat generation at both ends and a heat generation at the central portion was taken as shown in FIG. 11. Also the resistance ratio is defined as a resistance value of the second area of a single electrode when the total resistance value Rt is normalized to 1.

In the present embodiment, the resistance value is measured in a state where the heater is heated at 200° C., but, as the set temperature in the fixing process is provided in plural levels as explained in the embodiment 1, it is preferable that the aforementioned resistance ratio is satisfied in all the set temperatures selected in a printer (fixing apparatus).

In the heater of sheet-passing-direction current-feed type of the invention, the heat generating resistor preferably has a large PTC property, which can be achieved by reducing a content of palladium in the paste for forming the resistor.

In the heaters 1–4 mentioned above, different resistance values were obtained by changing the thicknesses of the heat generating resistor and the electrodes and the volumic resistivity (contents of Pd, glass, Ag etc.) of the heat generating resistor, but it is also possible to obtain a desired resistance value by varying the width, length etc. of the heat generating resistor and the electrodes so as to obtain a resistance ratio Rc/Rt of 1/60 or less at the set temperature in the fixing process (image heating process).

TABLE 5

Resistance ratio and difference in heat generation in heaters

| | Total resistance value Rt at normal temp. | Resistance value Rc of second area of electrode at normal temp. | Resistance ratio Rc/Rt at normal temp. | Total resistance value Rt at 200° C. | Resistance value Rc of second area of electrode at 200° C. | Resistance ratio Rc/Rt at 200° C. | Difference in heat generation (end - the other end) |
|---|---|---|---|---|---|---|---|
| Heater 5 (embodiment) | 20 Ω | 0.35 Ω | 1/57.1 | 30 Ω | 0.48 Ω | 1/62.5 | 9° C. |
| Heater 6 (embodiment) | 12 Ω | 0.17 Ω | 1/70.5 | 16 Ω | 0.2 Ω | 1/80 | 2° C. |
| Heater 7 (comp. ex. 3) | 11 Ω | 0.35 Ω | 1/31.4 | 11.4 Ω | 0.48 Ω | 1/23.7 | 25° C. |
| Heater 8 (comp. ex. 4) | 10.5 Ω | 0.17 Ω | 1/61.7 | 11.5 Ω | 0.2 Ω | 1/57.5 | 14° C. |

As will be apparent from the results of the heaters 5 and 6, the difference of heat generation was 10° C. or less in case the resistance ratio Rc/Rt was 1/60 or less at the fixing temperature of 200° C. The difference of heat generation of 10° C. or less is a practically acceptable level, and is preferably 10° C. or less, since a difference exceeding 10° C. may hinder a uniform fixation. It is also perceived that the temperature difference between the both ends of the heater became smaller as the resistance ratio Rc/Rt decreased.

Also the results of the heaters 7 and 8 indicates that a resistance ratio Rc/Rt larger than 1/60 resulted in a difference of heat generation exceeding 10° C., and the temperature difference became larger as the resistance ratio Rc/Rt increased.

Also the results of the heater 5 indicate that a practically acceptable temperature difference of 10° C. could be obtained in case the resistance ratio Rc/Rt, even if 1/60 or higher at the normal temperature, was 1/60 or less at the fixing temperature of 200° C.

On the other hand, the results of the heater 8 indicate that the temperature difference undesirable exceeds 10° C. in case the resistance ratio Rc/Rt, even if 1/60 or lower at the normal temperature, was 1/60 or higher at the fixing temperature of 200° C.

The present invention is not limited to the aforementioned embodiments but includes any and all variations within the technical concept of the invention.

This application claims priority from Japanese Patent Application Nos. 2004-015173 filed Jan. 23, 2004 and 2005-002697 filed Jan. 7, 2005, which are hereby incorporated by reference herein.

What is claimed is:

1. An image heating apparatus for heating an image formed on a recording material, comprising:

a heater, said heater including a substrate, a heat generating resistor formed on said substrate and first and second electrodes for supplying an electric power to said heat generating resistor;

a back-up member for forming a nip portion in cooperation with said heater;

control means which controls the electric power supply to said heat generating resistor in such a manner that a temperature of said heater is maintained at a set temperature during an image heating operation;

wherein the recording material passes through the nip portion;

wherein each of said first and second electrodes has a first area to be contacted with a power supplying connector and a second area provided at an end portion electrically opposite to the first area, the second areas are provided along a longitudinal direction of said substrate and said heat generating resistor is so provided as to electrically connect the second area of said first electrode and the second area of said second electrode;

wherein, within the second area of said first electrode, a portion electrically closest to the first area of said first electrode is provided in the vicinity of an end portion of said substrate in the longitudinal direction thereof, and within the second area of said second electrode, a portion electrically closest to the first area of said second electrode is provided in the vicinity of the other end portion of said substrate in the longitudinal direction thereof; and wherein, when the heater is at the set temperature, a resistance value Rc of the second area of either of said first and second electrodes and a resistance value Rt between a portion within the second area of said first electrode electrically closest to the first area of said first electrode and a portion within the second area of said second electrode electrically closest to the first area of said second electrode satisfy a relation:

$$Rc/Rt \leqq 1/30.$$

2. An image heating apparatus according to claim 1, wherein the second areas of said first and second electrodes are electrically connected with said heat generating resistor along the longitudinal direction.

3. An image heating apparatus according to claim 1, wherein the set temperature is variable.

4. An image heating apparatus according to claim 1, further comprising a rotary flexible sleeve of which an internal periphery is in contact with said heater;

wherein said flexible sleeve is pinched between said heater and said back-up member, and the recording material passes between said flexible sleeve and said back-up member.

5. A heater for use in an image heating apparatus, comprising:

a substrate;

a heat generating resistor formed on said substrate; and first and second electrodes for supplying an electric power to said heat generating resistor;

wherein each of said first and second electrodes has a first area to be contacted with a power supplying connector and a second area provided at an end portion electrically opposite to the first area, the second areas are provided along a longitudinal direction of said substrate, and said heat generating resistor is so provided as to electrically connect the second area of said first electrode and the second area of said second electrode;

wherein, within the second area of said first electrode, a portion electrically closest to the first area of said first electrode is provided in the vicinity of an end portion of said substrate in the longitudinal direction thereof, and within the second area of said second electrode, a portion electrically closest to the first area of said second electrode is provided in the vicinity of the other end portion of said substrate in the longitudinal direction thereof; and wherein, when the heater is at a set temperature for an image heating operation in said image heating apparatus, a resistance value Rc of the second area of either of said first and second electrodes and a resistance value Rt between a portion within the second area of said first electrode electrically closest to the first area of said first electrode and a portion within the second area of said second electrode electrically closest to the first area of said second electrode satisfy a relation:

$$Rc/Rt \leqq 1/30.$$

6. A heater according to claim 5, wherein the second areas of said first and second electrodes are electrically connected with said heat generating resistor along the longitudinal direction.

7. A heater according to claim 5, wherein the set temperature is variable.

8. An image heating apparatus for heating an image formed on a recording material, comprising:

a heater, said heater including a substrate, a heat generating resistor formed on said substrate and first and second electrodes for supplying an electric power to said heat generating resistor;

a back-up member for forming a nip portion in cooperation with said heater;

control means which controls the electric power supply to said heat generating resistor in such a manner that a temperature of said heater is maintained at a set temperature during an image heating operation;

wherein the recording material passes through the nip portion;

wherein each of said first and second electrodes has a first area to be contacted with a power supplying connector and a second area provided at an end portion electrically opposite to the first area, the second areas are provided along a longitudinal direction of said substrate and said heat generating resistor is so provided as to electrically connect the second area of said first electrode and the second area of said second electrode;

wherein, within the second areas of said first and second electrodes, portions electrically closest to the first areas are provided in the vicinity of an end portion of said substrate in the longitudinal direction thereof; and wherein, when the heater is at the set temperature, a resistance value Rc of the second area of either of said first and second electrodes and a resistance value Rt between a portion within the second area of said first electrode electrically closest to the first area of said first electrode and a portion within the second area of said second electrode electrically closest to the first area of said second electrode satisfy a relation:

$$Rc/Rt \leqq 1/60.$$

9. An image heating apparatus according to claim 8, wherein the second areas of said first and second electrodes are electrically connected with said heat generating resistor along the longitudinal direction.

10. An image heating apparatus according to claim 8, wherein the set temperature is variable.

11. An image heating apparatus according to claim 8, further comprising a rotary flexible sleeve of which an internal periphery is in contact with said heater;

wherein said flexible sleeve is pinched between said heater and said back-up member, and the recording material passes between said flexible sleeve and said back-up member.

12. A heater for use in an image heating apparatus, comprising:

a substrate;

a heat generating resistor formed on said substrate; and first and second electrodes for supplying an electric power to said heat generating resistor;

wherein each of said first and second electrodes has a first area to be contacted with a power supplying connector and a second area provided at an end portion electrically opposite to the first area, the second areas are provided along a longitudinal direction of said substrate and said heat generating resistor is so provided as to electrically connect the second area of said first electrode and the second area of said second electrode;

wherein, within the second areas of said first and second electrodes, portions electrically closest to the first areas are provided in the vicinity of an end portion of said substrate in the longitudinal direction thereof; and wherein, when the heater is at a set temperature for an image heating operation in said image forming apparatus, a resistance value Rc of the second area of either of said first and second electrodes and a resistance value Rt between a portion within the second area of said first electrode electrically closest to the first area of said first electrode and a portion within the second area of said second electrode electrically closest to the first area of said second electrode satisfy a relation:

$$Rc/Rt \leqq 1/60.$$

13. A heater according to claim 12, wherein the second areas of said first and second electrodes are electrically connected with said heat generating resistor along the longitudinal direction.

14. A heater according to claim 12, wherein the set temperature is variable.

* * * * *

UNITED STATES PATENT AND TRADEMARK OFFICE

CERTIFICATE OF CORRECTION

PATENT NO. : 7,203,438 B2
APPLICATION NO. : 11/038066
DATED : April 10, 2007
INVENTOR(S) : Masahito Omata et al.

It is certified that error appears in the above-identified patent and that said Letters Patent is hereby corrected as shown below:

COLUMN 1
Line 58, “layer 19” should read --layer 20--.

COLUMN 5
Line 65, “Thus” should read --The--.

COLUMN 6
Line 13, “receiving” should read --received--.

COLUMN 8
Line 19, “magnified-views” should read --magnified views--

COLUMN 10
Line 7, “both in the” should read --in both of the--.
Line 57, “the both” should read --both--.
Line 63, “the both” should read --both--.

COLUMN 11
Line 1, “Such phenomenon” should read --Such a phenomenon--.
Line 9, “value f the” should read --value of the--.

COLUMN 17
Line 49, “obtained” should read --obtained by--.

COLUMN 18
Line 47, “between the both” should read --between both--.
Line 50, “indicates” should read --indicate--.
Line 62, “temperature difference undesirable” should read --temperature difference--.

COLUMN 20
Line 51, “obtained” should read --obtained by--.

UNITED STATES PATENT AND TRADEMARK OFFICE

CERTIFICATE OF CORRECTION

PATENT NO. : 7,203,438 B2
APPLICATION NO. : 11/038066
DATED : April 10, 2007
INVENTOR(S) : Masahito Omata et al.

It is certified that error appears in the above-identified patent and that said Letters Patent is hereby corrected as shown below:

COLUMN 21
Line 50, "between the both" should read --between both--.
Line 52, "indicates" should read --indicate--.
Line 64, "temperature difference undesirable" should read --temperature difference--.

COLUMN 23
Line 2, "substrate" should read --substrate,--.

COLUMN 24
Line 28, "substrate" should read --substrate,--.

COLUMN 25
Line 3, "substrate" should read --substrate,--.

Signed and Sealed this

Thirteenth Day of May, 2008

JON W. DUDAS
*Director of the United States Patent and Trademark Office*